US005899502A

United States Patent [19]

Del Giorno

[11] Patent Number: 5,899,502

[45] Date of Patent: May 4, 1999

[54] METHOD OF MAKING INDIVIDUALIZED RESTAURANT MENUS

[76] Inventor: Joseph Del Giorno, 157 Ocean Ave., East Rockaway, N.Y. 11518

[21] Appl. No.: 08/088,136

[22] Filed: Jul. 7, 1993

[51] Int. Cl.[6] ..... B42D 15/02; G06F 9/30

[52] U.S. Cl. ..... 283/67; 283/60.2; 283/117; 364/413.29

[58] Field of Search ..... 283/43.1, 55, 56, 283/60.1, 60.2, 67, 117; 40/299; 235/375, 454, 3; 364/413.29

[56] References Cited

U.S. PATENT DOCUMENTS

| | | | |
|---|---|---|---|
| 3,884,507 | 5/1975 | Fumel | 283/60.1 |
| 4,471,218 | 9/1984 | Culp | 235/454 X |
| 4,616,853 | 10/1986 | Pensavecchia | 283/60.2 |
| 4,723,794 | 2/1988 | Shannon | 283/60.1 X |
| 4,807,169 | 2/1989 | Overbeck | 364/413.29 X |
| 4,894,793 | 1/1990 | Ikemoto et al. | 364/413.29 X |
| 4,924,389 | 5/1990 | Gerbaulet et al. | 364/413.29 |
| 4,954,954 | 9/1990 | Madsen et al. | 364/413.29 |
| 4,979,901 | 12/1990 | Robertson et al. | 283/48.1 X |

FOREIGN PATENT DOCUMENTS

| | | | |
|---|---|---|---|
| 138672 | 7/1985 | Japan | 364/413.29 |
| 1264898 | 10/1989 | Japan | 283/60.2 |

OTHER PUBLICATIONS

"Electronic Diet Controller" Moran, Computer Design, Aug. 1977, pp. 116–118.

"Eat Smart Nutrition Computer Program" Pillsbury Company, Nov. 1981.

Smolka "CFDware—Software for Carefree Dining" May 18, 1993.

*Primary Examiner*—Peter Vo

*Attorney, Agent, or Firm*—Nolte, Nolte & Hunter

[57] ABSTRACT

A method of making an individualized restaurant menu for a customer desirous of avoiding ingestion of customer-selected ingredients. A database is loaded into a computer. Names of all the ingredients used by the restaurant are loaded into the database. A plurality of recipes are loaded into the database. Each recipe comprises ingredients selected from the ingredients, named in the database. The customer selects any ingredients the customer wishes to avoid. The customer's name is entered into the database in association with the names of ingredients which the customer has selected as to-be-avoided. The database of recipes is automatically searched for the ingredients-to-be-avoided. All available recipes not containing ingredients-to-be-avoided are printed on a menu, customized for the customer. The menu includes the customer's name, the names of ingredients-to-be-avoided, and a list of names of servings of selected available recipes.

11 Claims, 9 Drawing Sheets

19

23

42

52

74

82

6/30/93

ALLERTEK, INC.™—YOUR KEY TO CAREFREE DINING™—IS PLEASED TO PRESENT

96 → AL ERGIC

WITH YOUR CAREFREE DINING MENU

YOU REQUESTED THE FOLLOWING INGREDIENTS BE ELIMINATED FROM YOUR MENU:

101 → ANCHOVIES 102 → GARLIC 103 → PAPRIKA

PLEASE NOTE: ONLY THE ITEMS LISTED BELOW ARE FREE OF THE SUBSTANCES YOU ASKED TO AVOID. DAILY SPECIALS ARE NOT INCLUDED.

106 →

APPETIZERS

BAKED STUFFED CLAMS
CALAMARI
CLAMS CASINO
FRIED MOZZARELLA CUBES
FARM RAISED MUSSELS
SHRIMP SCAMPI

SOUPS

SCOTT'S DISH
LENTIL SOUP
SARAH'S SOUP

SALADS

SARAH'S DISH
SPINACH SALAD
CARROT SALAD
TUNA SALAD
CHEF'S SALAD

ENTREES

PIZZA
SCRAMBLED EGGS GARVEY
TURKEY - PLAIN
STEAK
BLACKENED STEAK
BEEF STEW
CHICKEN MARSALA

DESSERTS

LEMONADE - PLAIN
BLUEBERRY PIE
CHOCOLATE MOUSSE
APPLE PIE

FIG. 9

94

METHOD OF MAKING INDIVIDUALIZED RESTAURANT MENUS

A portion of the disclosure of this patent document contains material which is subject to copyright protection. The copyright owner has no objection to the facsimile reproduction by anyone of the patent document or the patent disclosure, as it appears in the Patent and Trademark Office patent file or record, but otherwise reserves all copyright rights whatsoever.

FIELD OF THE INVENTION

The present invention relates to a method of making individualized restaurant menus, particularly for a customer desirous of avoiding ingestion of customer-selected ingredients.

BACKGROUND OF THE INVENTION

There is a growing awareness of the importance of diet, and there is a consciousness among many people that certain ingredients may be harmful to their health. Persons who are allergic to certain ingredients may suffer adverse reactions, including in extreme cases anaphylactic shock and death, as a result of ingesting such ingredients.

Others have been advised by their doctors to avoid such things as cholesterol or sodium. Some people simply dislike the taste of certain ingredients.

Typically, a restaurant menu provides little information to the customer about what ingredients are in the recipe of any given serving listed on the menu.

An allergic person may have to engage in a long discourse with the waiter regarding an ingredient the allergic person is trying to avoid, with the waiter making frequent trips to the kitchen to consult with the cook about his recipes.

OBJECTS

It is an object of the present invention to provide a system whereby a customer can inform the restaurant as to which ingredients the customer wishes to avoid, and the restaurant can respond by automatically printing a customized, individualized, personalized restaurant menu; the menu consisting only of selected servings in which the offending selected ingredients-to-be-avoided are absent.

As an additional benefit, ingredients which the cook has run out of can also be selected off such menus, thereby saving the customer disappointment, and saving the waiter false starts and futile order taking.

It is an additional object of the present invention to provide increased safety; so that a restaurant's surprise ingredient, not usually found in a conventional serving of the name on the menu, will be less likely to surprise an allergic person who might otherwise, for example, assume that there are no peanuts in the restaurant's chili, order the chili, and die of the resulting allergic reaction to the peanut powder in the restaurant's special-secret-ingredient-chili.

BRIEF DESCRIPTION

The present invention comprises a method of making an individualized restaurant menu for a customer desirous of avoiding ingestion of customer-selected ingredients. The method preferably comprises the following steps:

A database is loaded into a computer.

A plurality of common names of ingredients, such as foods or additives, is loaded into an ingredients part of said database. The ingredients comprise all the ingredients used by the restaurant. Where an ingredient is not included in the database, there is provision for adding new ingredients to the database.

The recipes of the restaurant are then loaded into a second part of the database. Each recipe comprises ingredients which consist only of ingredients selected from the ingredients named in the database. While loading the recipes into the database, if an ingredient used in the recipe is not present on the ingredients part of the database, it may at that time be added to the ingredients database.

Preferably the computer with database is located at the restaurant where convenient and immediate access may be had by the waiters, maitre d, or even by the customer. However, it is of course envisioned that the computer containing the database can be remotely located and be accessible from the restaurant. When a customer enters the restaurant, the customer is informed by signs, by advertising, by the maitre d, or by his waiter that he has the option of obtaining a customized menu which won't contain ingredients the customer has selected as to-be-avoided.

The customer's name or other identifier is then entered into the computer along with the names of ingredients which the customer has chosen to avoid.

When the entry has been completed, the computer and database are actuated to search automatically the database of recipes for for the ingredients to be avoided. Those recipes not containing the offending selected-to-be-avoided ingredients are retrieved. The serving names of those recipes are printed-out upon a menu, said menu thereby customized and individualized for the customer.

The menu preferably comprises the customer's name, the names of ingredients avoided, and a list of names of servings, said servings consisting of the selected available recipes which do not contain the offending ingredients.

BRIEF DESCRIPTION OF THE DRAWINGS

FIG. 9, is a sample menu which has been generated by the present invention.

DETAILED DESCRIPTION OF THE DRAWING

Figure 1:
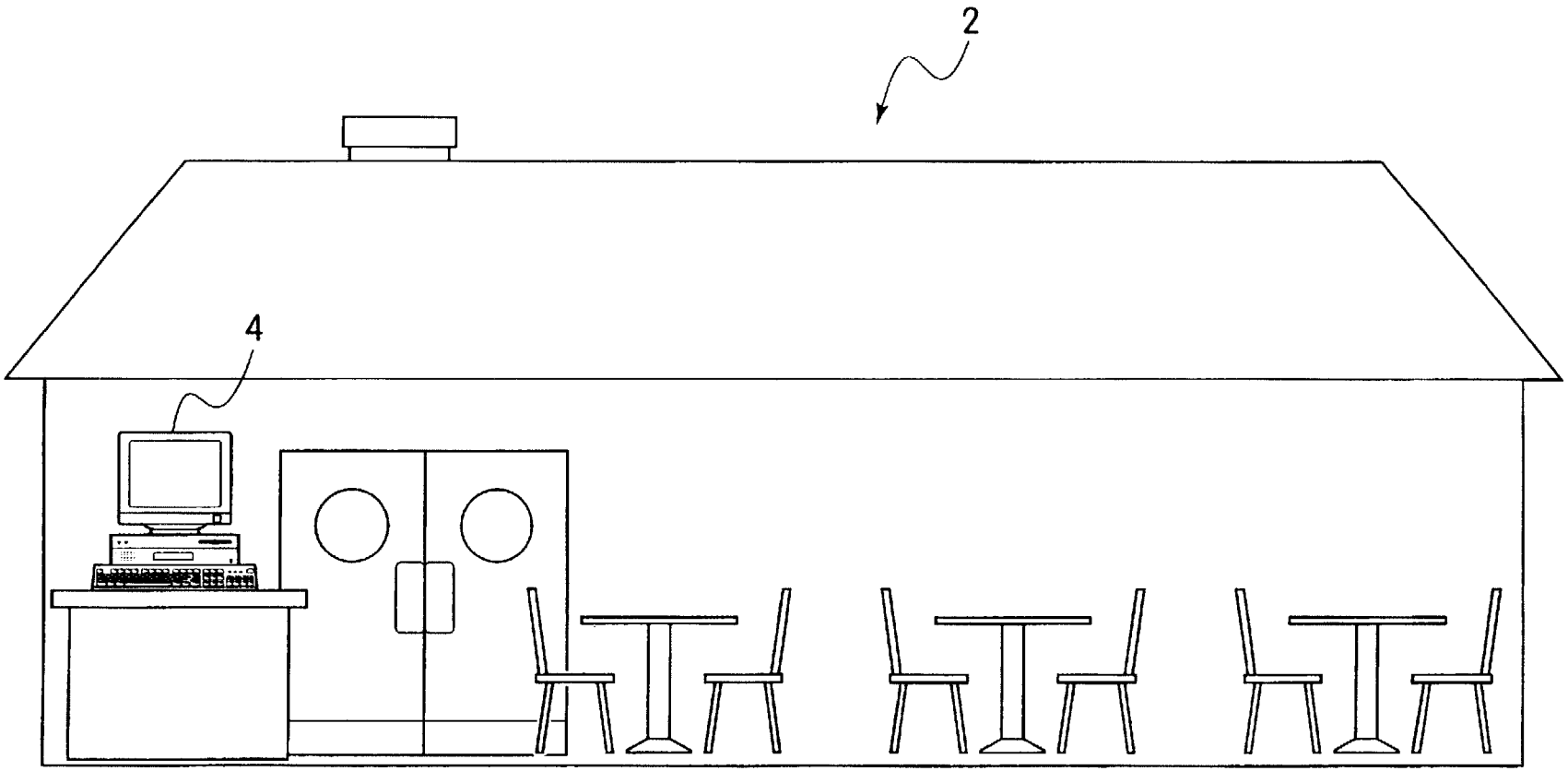
FIG. 1, is a representational diagram of a restaurant with a computer setup.

In the preferred embodiment, a restaurant, shown in FIG. 1, is preferably provided with an on-site computer set-up 4.

Figure 2:
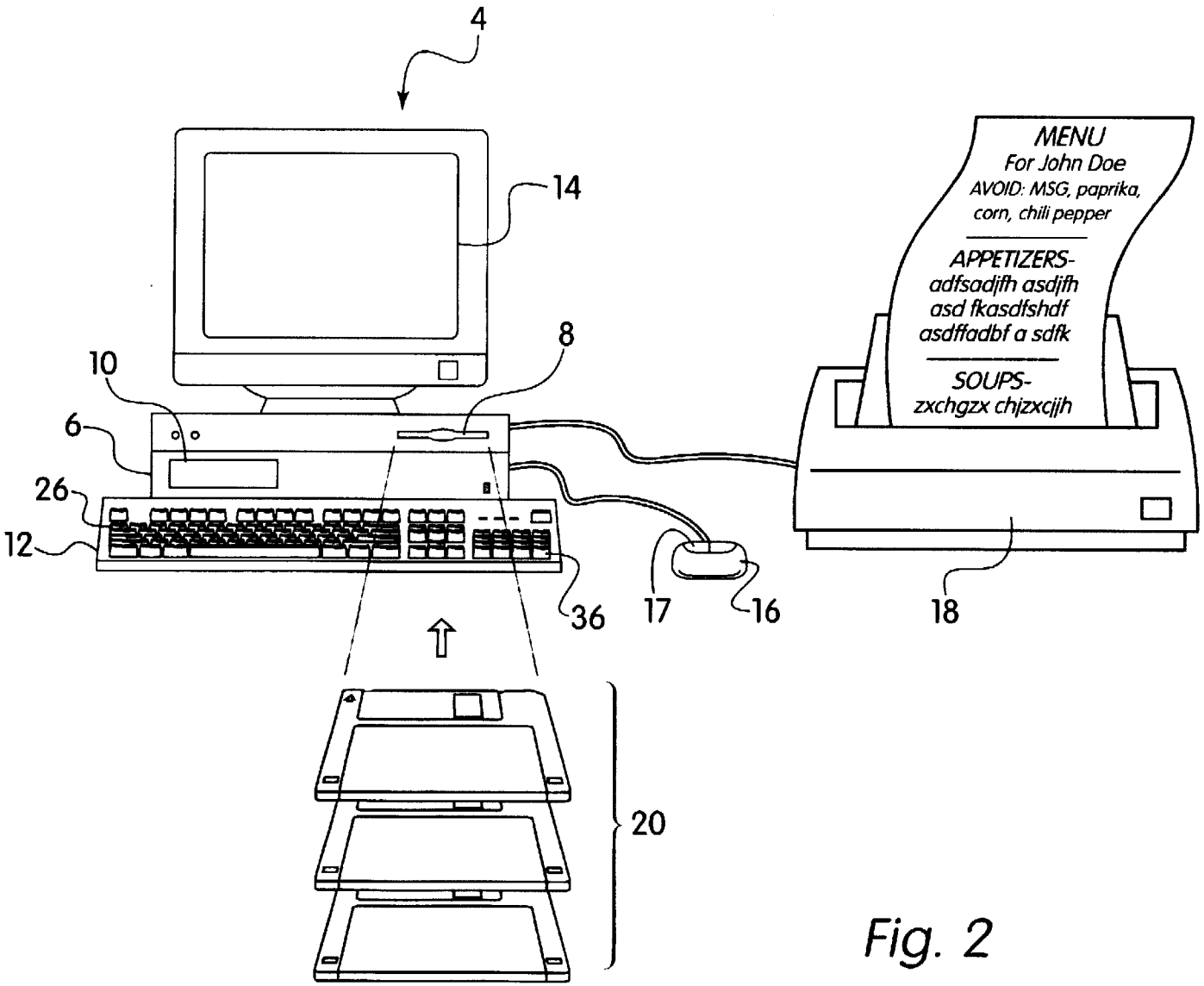
FIG. 2, is a block diagram showing various elements of the computer setup.

As shown in FIG. 2, the computer set-up 4 comprises a DOS-compatable computer 6, floppy drive 8, hard drive 10, keyboard 12 for inputs, video display 14, mouse 16, and printer 18. A program is stored on floppy discs 20, and preferably comprises an executable file comprising a database such as FoxPro 2.0, and a program which will be described herein.

Preferably, an executable file is installed with various data files by conventional means such as by loading floppies 20 into floppy drive 8, and installing the needed files on the hard drive 10.

Where an executable file has been created, the program can then be actuated by typing a command such as: "CFD (Enter)."

In a present developmental embodiment, batch file types required commands which load the FoxPro environment, and the program is run from within that environment. See for example the following batch file named "fox.bat":

```
c:
cd/dos
mouse
d:
cd/cfd/program
d:/foxpro2/foxpro
```

Actuate this batch file by typing "FOX (Enter)." The FoxPro then loads onto the computer. The command "DO MAIN (Enter)" runs the program.

Figure 3:
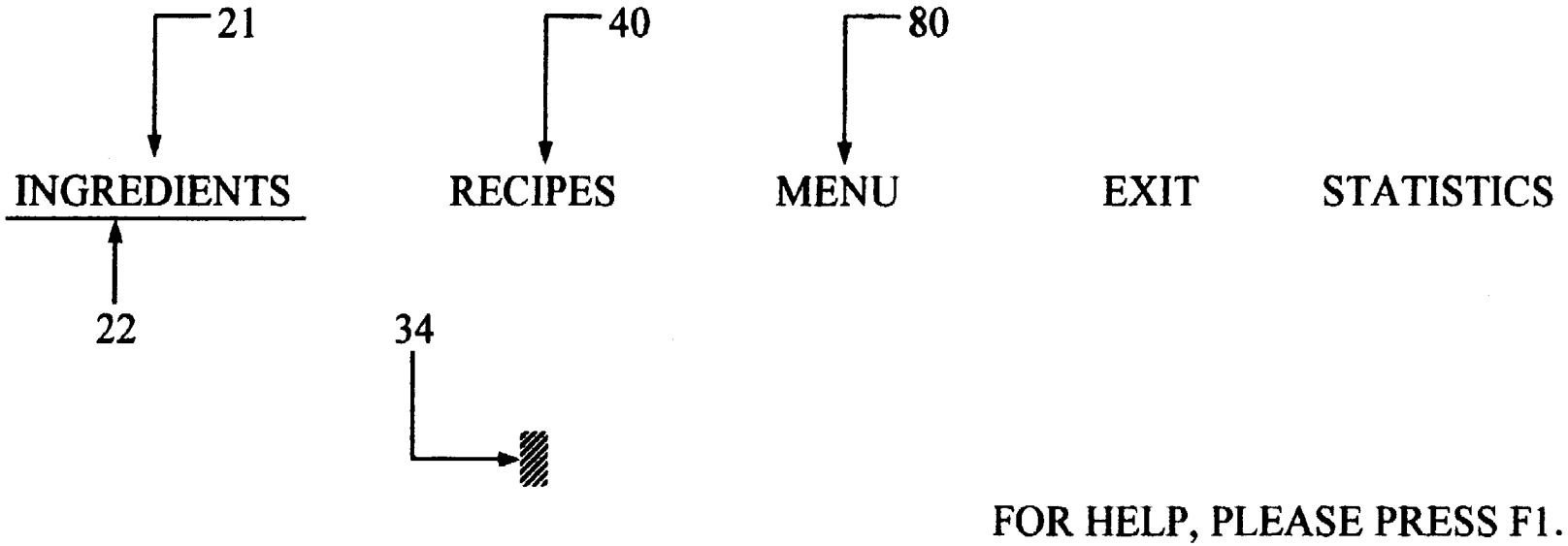
FIGS. 3–8, are print outs of computer screens, which screens may be generated by the program of the present invention.

After the usual introduction screens the user is presented with a program menu screen 19, FIG. 3.

Initially, a user familiar with the restaurant's ingredients should select the ingredients field 21 either by depressing tab key 26 until cursor 22 is located on "Ingredients" 21, then pressing the "Enter" key 36.

Alternatively, mouse cursor 34 may be moved by mouse 16 in the conventional manner to "ingredients" 21, and mouse button 17 may be clicked.

These command procedures are consistent with conventional window-like command practices, and are consistent throughout the program.

Figure 4:
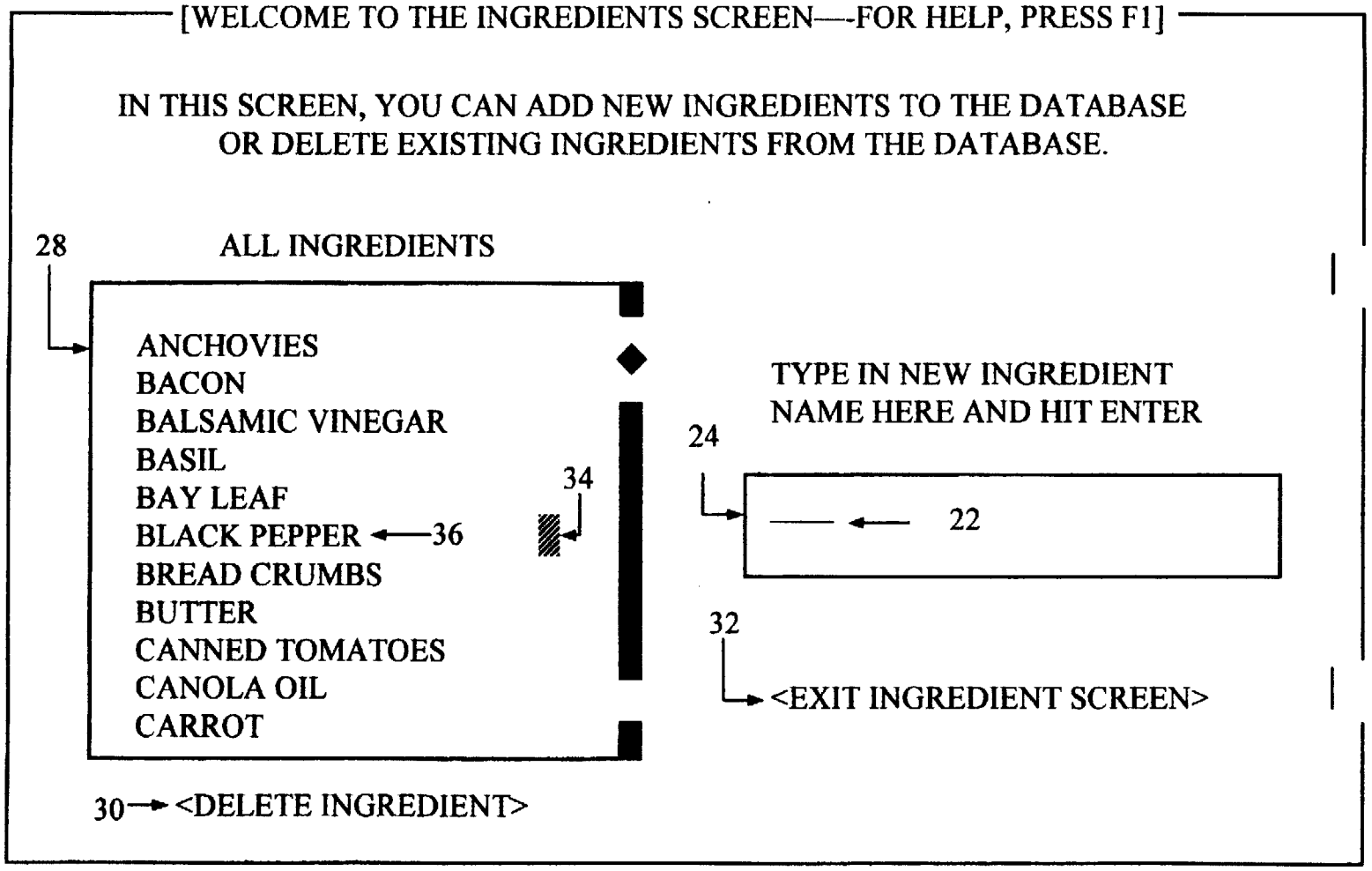

This actuates Ingredients Screen 23, shown in FIG. 4. By default, cursor 22 starts in the "new ingredient name" entry field 24. By pressing the tab key 26 (FIG. 2), cursor 22 (FIG. 4) may be moved about Ingredients Screen 23 to the ingredients list 28, the "Delete Ingredient" command 30 or the "Exit Ingredients Screen" command 32.

Included with the program will be a database file of about 200 common ingredients. The restaurant may add or delete ingredients as follows.

Mouse 16, in FIG. 2, can also be used in conventional fashion, to move mouse cursor 34 around the screen. Mouse cursor 34 may be conventually moved about screen 23, for example, to select "black pepper" 36 from ingredients list 28. If the restaurant does not use black pepper, mouse cursor 34 or cursor 22 may be moved to "Delete Ingredient" command 30 and mouse-clicked or "Enter" keyed to delete black pepper from the list of ingredients.

Absent any movement from the cursor upon opening of the screen, or when the mouse or cursor is moved to the ingredient entry field 24 and clicked, an ingredient name may be typed in, and will be entered onto the list 28 when the enter key 36, is depressed.

If the ingredient is already upon the list an error tone will be generated and the ingredient will disappear from "new ingredient name" field 24. Otherwise the ingredient field will empty and the name of the ingredient will be placed into the database of listed ingredients in alphabetical order.

Ingredients should be carefully selected to include the most common names of the ingredients. Cross referencing is desirable so that, for example, an allergy to milk will also trigger questions regarding an exclusion of cheese products; and sulfites may trigger wines, salads, and ciders.

The ingredients screen is usually used only by a person knowledgeable of the restaurant's ingredients, such as the manager, owner, chief chef, or purchasing agent. When such a person has entered all the likely ingredients into the ingredients list, the program is ready to produce menus consisting of the ingredients upon this list.

The next step in setting up the program for a restaurant's use is to exit the ingredients screen by cursoring to the "Exit Ingredients Screen" command 32 and pressing "Enter" 36 (FIG. 2), or by conventionally clicking on said command with the mouse button 17.

This again will call up the program menu screen 19 of FIG. 3. Using the "Tab" and "Enter" keys, or the mouse, the "Recipes" command 40 may be selected from the program menu screen 19, of FIG. 3.

Figure 5:
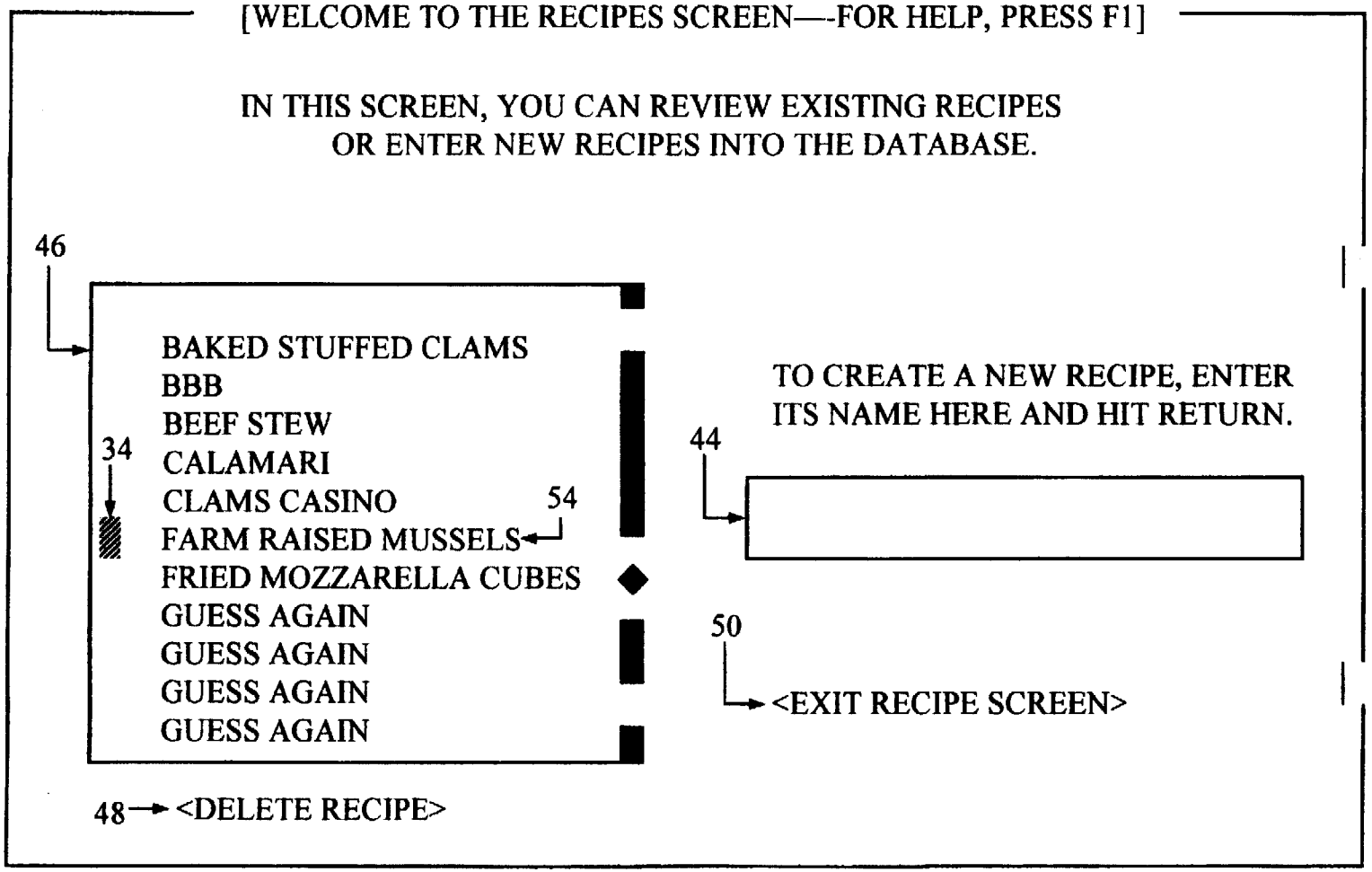

This actuates the recipe screen 42, of FIG. 5.

Recipe screen 42 comprises "new recipe . . . name" field 44, recipe list 46, "Delete Recipe" command 48, and "Exit Recipe Screen" command 50.

To create a new recipe, the chef, manager, or the like will place the cursor in the "new recipe . . . name" field 44, and type the name of the new recipe, which will later be printed on the menu as the name of the serving made from this recipe.

When done typing the name, press "Enter" 36 and the recipe editing screen 52 (FIG. 6) is displayed. Alternatively, in FIG. 5, the mouse may be clicked upon the name of a dish, such as "farm raised mussels" 54, and clicked once followed by using the "Enter" key 36, or double clicked on left mouse button 17, FIG. 2, to edit that particular recipe.

Turning again to FIG. 6, we see recipe name field 54, the type of dish field 56, the "All Ingredients" list 58, the change recipe list category command 60, and the recipe ingredients list 62. To add mushrooms to the recipe for scrambled eggs, mouse cursor 34 is placed in the "mushrooms" field 66, and is then clicked once to move the highlight to mushrooms followed by pressing "Enter" key 36 (FIG. 2), or Mouse button 17 is then doubled clicked. This adds mushrooms (FIG. 6) to its alphabetical location in the "Recipe Ingredients" list 62.

Ingredients may be scrolled to by:

- placing the highlighted cursor 22 in the all ingredients list, and
- using the up arrow, down arrow, page up, or page down keys on the keyboard, or
- by moving mouse cursor 34 to up arrow box 68, or down arrow box 70, and
- clicking on either of those boxes to scroll the list up or down.

This is in accord with conventional windows style command functions. Similar control features are available on the other screens.

Figure 6:
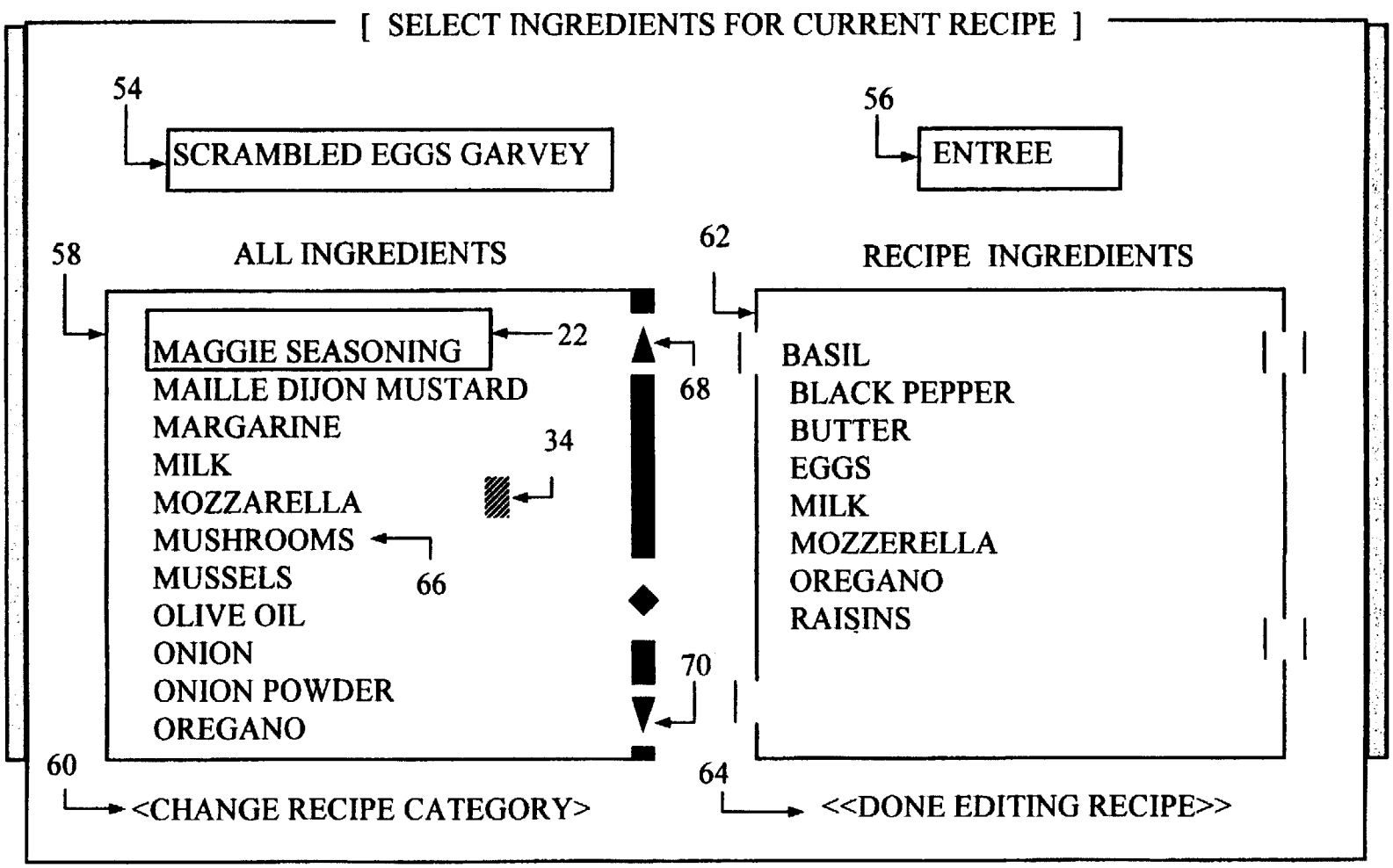
Figure 7:
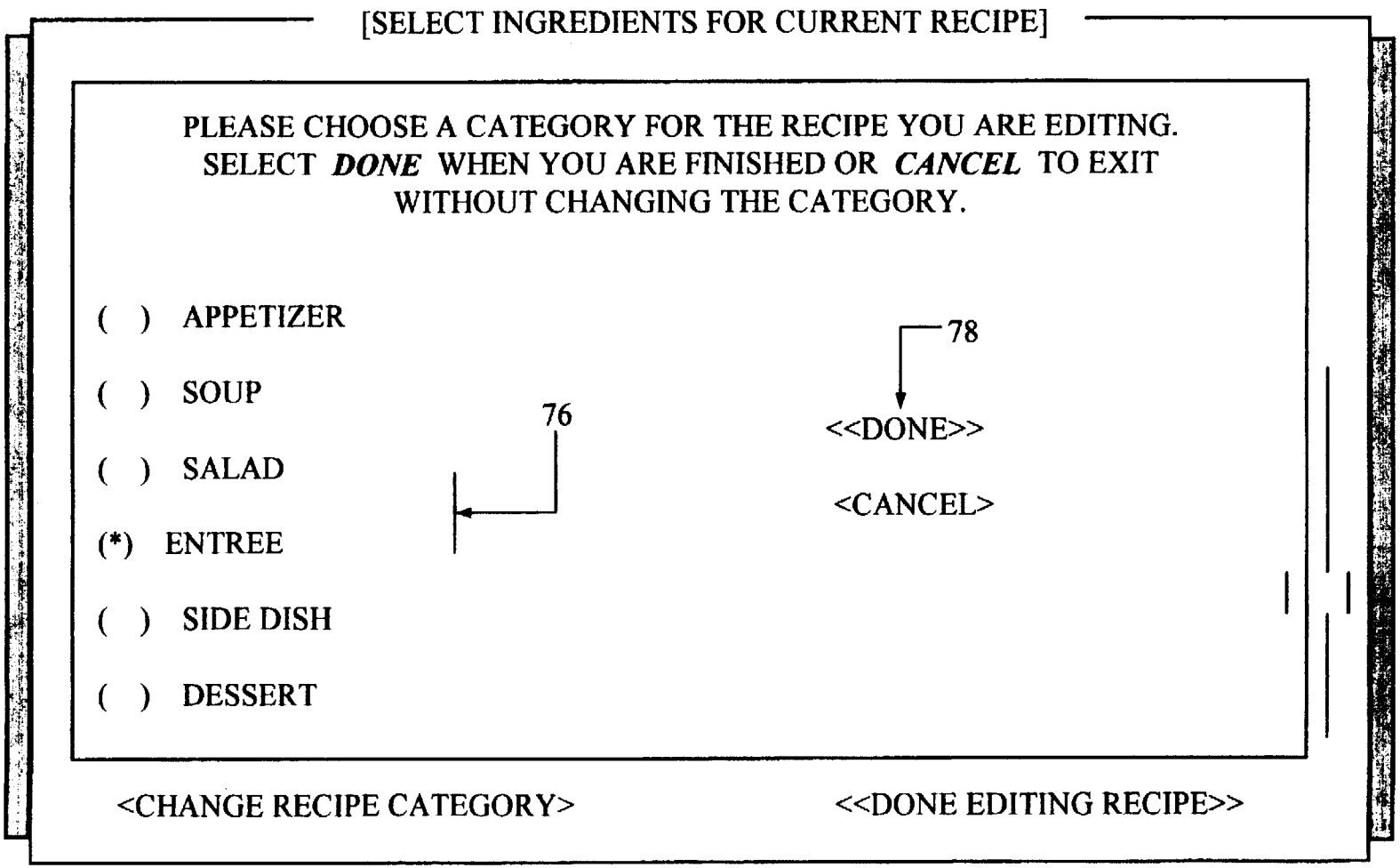

When a new recipe is typed onto the recipe screen 42 (FIG. 5) in field 44 (FIG. 5) and Entered, or when the "Change Recipe Category" command 60 is actuated in FIG. 6, the "Change Recipe Category" screen 74 is actuated. (FIG. 7) Screen 74 comprises a plurality of option buttons 76, one of which must be selected in order to categorize the serving as appetizer, soup, salad, entree, side dish, or desert. Other categories are envisioned, but are not yet in the presently preferred embodiment. When the dish has been assigned to a category, by selecting an option by conventional means such as described above, the "Done" switch 78 may be selected to return to the recipe editing screen 52, of FIG. 6.

When done, actuate the "Done Editing Recipe" command 64 to return to the recipe screen 42 of FIG. 5. By this procedure all the recipes used by the restaurant can be entered into the database.

Once all the recipes have been entered, the program is ready for daily use in creating menus. Actuate "Exit Recipe Screen" command 50 to return program menu screen 19, of FIG. 3.

Figure 8:
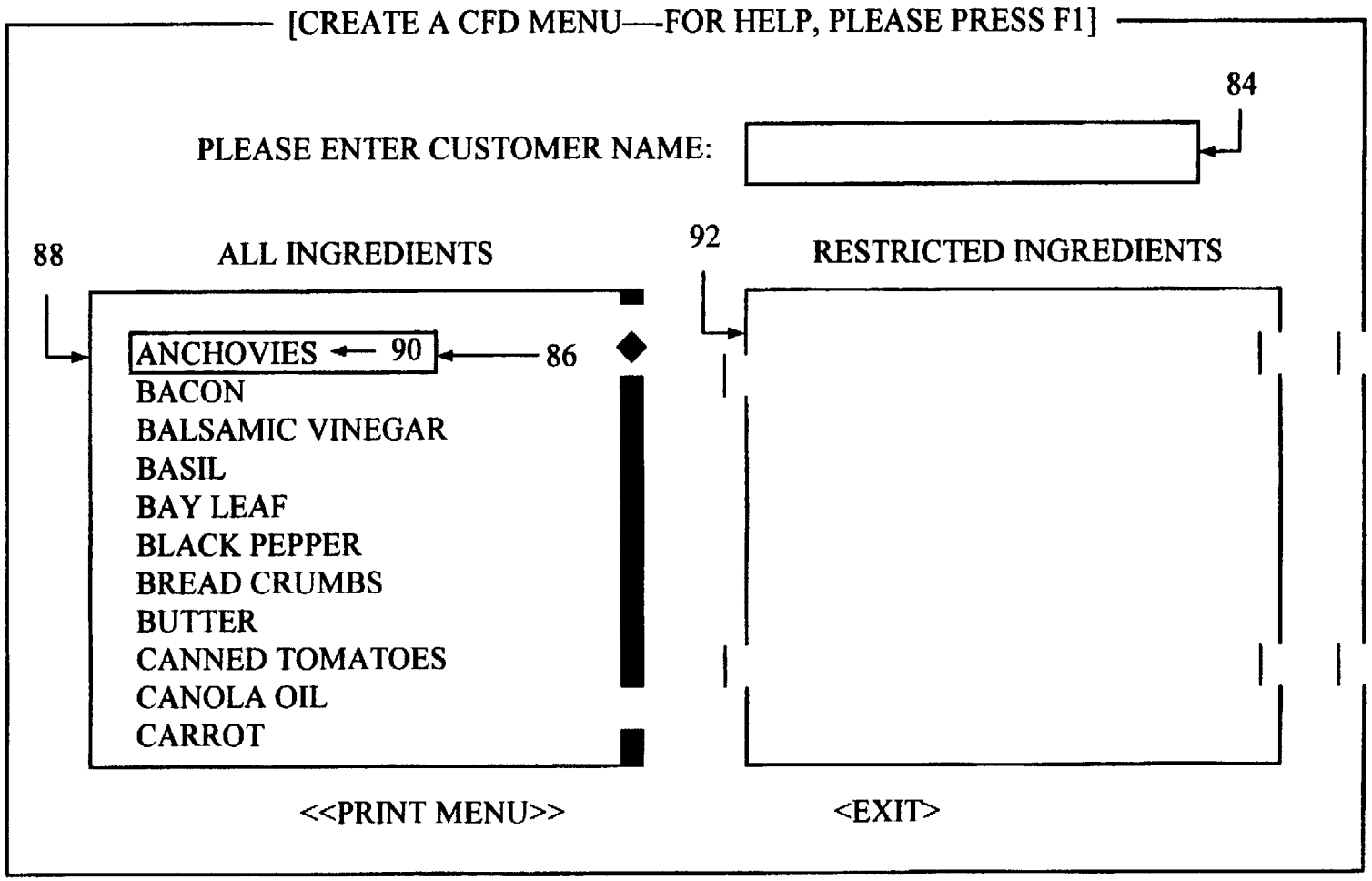

Actuate "Menu" command 8, and the "create a menu" screen 82 (FIG. 8) will appear. The system is now ready to service restaurant customers.

A restaurant attendant such as the maitre d, or a waiter or waitress first inquires if there are any foods or additives which the customer wishes to avoid. If the customer answers in the affirmative the customer's name and the ingredients-to-be-avoided are then taken.

The customer's name is entered into "customer name" field 84, by typing the customer's name onto keyboard 12. Depressing the "Enter" key enters the customer's name and moves the highlight cursor 86 to the first item in "all ingredients" field 88. Depressing the first letter on the keyboard of the ingredient-to-be-avoided cursors to the beginning of those alphabetically listed ingredients starting with that letter. Depressing the first two letter keys will narrow the search further, to the names beginning with those first two letters. Arrow keys and the mouse can be used to maneuver through this list until the cursor is upon the desired ingredient to be avoided, such as anchovies 90. Double clicking on anchovies with the mouse, or pressing "Enter" with the cursor on "anchovies," will add anchovies to the "Restricted Ingredients" list in field 92. In this manner any number of ingredients may be selected to avoid all undesired foods, and additionally any ingredients which have been used up and are out of stock can also be de-selected to avoid offering unavailable foods.

A menu such as 94, in FIG. 9, is then printed out including:

a customer name 96, the ingredients to be eliminated 101–103, and the menu of the names 106 of those servings whose recipes do not contain the offending ingredients 101–103.

As an added benefit, the customer can make his order by circling or marking the names of the servings he desires and returning the marked up menu to the waiter, for placement directly in the kitchen. This further reduces the possibility that a cook will inadvertently place an offending ingredient into the serving, and has the additional side benefit of reducing the possibility of an erroneous order. It can also help rebut a customer's claim that an undesired order was made by a server's error.

In a litigation, if a customer neglected to inform the restaurant of a dangerous ingredient, the menu would provide evidence of what ingredients the customer asked to exclude, and evidence of what the customer actually ordered.

On the following pages the program used in the presently preferred embodiment is presented:

```
*************************************************
*                                               *
*   CFDware -- Software for Carefree Dining     *
*                                               *
* Application name:             CFDware         *
* Author:                       Scott A. Smolka *
* Copyright holder:             Allertek, Inc.  *
* Copyright date:               1993            *
*                                               *
*   ALLERTEK, INC. and CAREFREE DINING are      *
*                 trademarks.                   *
*                                               *
*                Main Program                   *
*                                               *
*************************************************

set notify off
set safety off
set talk off

activate window command
hide window command
deactivate window command
release window command
activate screen
for i = 0 to 24
  @ i,0 say replicate(" ",80) color scheme 5
next
do welcome.spr
if !used("part")
  use part
  set order to tag pname
endif
if !used("temp")                && subset of widget w/out restricted parts
  select 0
  use temp
  set order to tag wtype
endif
if !used("widget")
  select 0
  use widget
  set order to tag wname
endif
if !used("wp")
  select 0
  use wp
  set order to tag wname
endif
if !used("restrict")    && set of user-restricted parts
  select 0
  use restrict
  set order to tag pname
endif
if !used("order")               && customer order info
  select 0
  use order
  set order to tag cname
endif
set deleted on
push menu _msysmenu
on key label f1 do cfdhelp with "", "MENU"
set help to cfdhelp
set help on
set topic to
@ 15,0 say padc("For help, please press F1.",80) color scheme 5
do main.mpr
activate menu _msysmenu
do foxpro
```

```
*****************************************************
*                                                   *
* Called by report to produce the next three widgets *
* in the current group, should there be that many.  *
*                                                   *
*****************************************************

if eof()
  return ""
endif

widgtype = temp.wtype                  && found one
x = left(temp.wname,25)
skip

if eof()                               && eof after one widget
  return x
endif

if temp.wtype = widgtype               && found a 2nd one
  x = x + space(2) + left(temp.wname,25)
  skip
else                                   && 2nd one in next group
  skip -1
  return x
endif

if eof()                               && eof after 2 widgets
  return x
endif

if temp.wtype = widgtype               && found a 3rd one
  x = x + space(2) + left(temp.wname,25)
  return x
else                                   && 3rd one in next group
  skip -1
  return x
endif
```

```
*****************************************************
*                                                   *
* Called by report to print the next three restricted *
* parts, should there be that many.                 *
*                                                   *
*****************************************************
private x
select restrict
go top
do while !eof()
  x = left(restrict.pname,25)
  skip
  if !eof()
    x = x + space(2) + left(restrict.pname,25)
    skip
  endif
  if !eof()
    x = x + space(2) + left(restrict.pname,25)
    skip
  endif
  ? x
  *_plineno = _plineno + 1
enddo
*_plineno = _plineno - 1
*_plength = 50
return ""
```

```
*******************************************************
*                                                     *
* Code executed when user presses F1, the help key.   *
*                                                     *
*******************************************************

parameters cTopic, cMenu
set topic to cTopic
help
if !empty(cMenu)
  activate menu _msysmenu
endif

*******************************************************
*                                                     *
* Called by main.mpr to add/edit a recipe and then come *
* back and do another.                                *
*                                                     *
*******************************************************

set sysmenu off
on key label f1 do cfdhelp with "recipes"
button = 0
do while  button = 0 .and. lastkey() != 27
  do widget.spr
  select wp
  set filter to
enddo
on key label f1 do cfdhelp with "", "MENU"
set topic to
set sysmenu on
activate menu _msysmenu

*************************************************
*                                               *
*  Code to determine which widgets (recipes)    *
*  can appear in report (menu); i.e., those     *
*  without any restricted parts (ingredients).  *
*                                               *
*************************************************

select temp
zap
append from widget
select restrict
go top
do while !eof()
  select wp
  go top
  do while !eof()
    if upper(wp.pname) = upper(restrict.pname)
      select temp
      delete all for temp.wname = wp.wname
      select wp
    endif
    skip
  enddo
  select restrict
  skip
enddo
go top
select temp
pack
set order to tag wname
set order to tag wtype
go top
report form report to printer noconsole
* report form report to file test.tst
```

```
*       VDDDDDDDDDDDDDDDDDDDDDDDDDDDDDDDDDDDDDDDDDDDDDDDDDDDDDDDDDDDDDDDD7
*       :                                                                 :
*       :                    Main Menu Definition                         :
*       :                                                                 :
*       SDDDDDDDDDDDDDDDDDDDDDDDDDDDDDDDDDDDDDDDDDDDDDDDDDDDDDDDDDDDDDDDD=
*

SET SYSMENU TO

SET SYSMENU AUTOMATIC

DEFINE PAD _qgt0zf5sh OF _MSYSMENU PROMPT "\<Ingredients" COLOR SCHEME 3
DEFINE PAD _qgt0zf5su OF _MSYSMENU PROMPT "\<Recipes" COLOR SCHEME 3
DEFINE PAD _qgt0zf5t3 OF _MSYSMENU PROMPT "\<Menu" COLOR SCHEME 3
DEFINE PAD _qgt0zf5td OF _MSYSMENU PROMPT "\<Exit" COLOR SCHEME 3
DEFINE PAD _qgt0zf5tn OF _MSYSMENU PROMPT "\<Statistics" COLOR SCHEME 3
ON SELECTION PAD _qgt0zf5sh OF _MSYSMENU do part.spr
ON SELECTION PAD _qgt0zf5su OF _MSYSMENU do widget.prg
ON SELECTION PAD _qgt0zf5t3 OF _MSYSMENU do list2.spr
ON PAD _qgt0zf5td OF _MSYSMENU ACTIVATE POPUP exit
ON SELECTION PAD _qgt0zf5tn OF _MSYSMENU do stats.spr

DEFINE POPUP exit MARGIN RELATIVE SHADOW COLOR SCHEME 4
DEFINE BAR 1 OF exit PROMPT "Exit to \<FoxPro"
DEFINE BAR 2 OF exit PROMPT "Exit to \<DOS"
ON SELECTION BAR 1 OF exit do foxpro
ON SELECTION BAR 2 OF exit quit
```

```
*       VDDD
```

```
DEFINE POPUP _medit MARGIN RELATIVE SHADOW COLOR SCHEME 4
DEFINE BAR _MED_UNDO OF _medit PROMPT "\<Undo" ;
        KEY CTRL+U, "^U"
DEFINE BAR _MED_REDO OF _medit PROMPT "\<Redo" ;
        KEY CTRL+R, "^R"
DEFINE BAR _MED_SP100 OF _medit PROMPT "\-"
DEFINE BAR _MED_CUT OF _medit PROMPT "Cu\<t" ;
        KEY CTRL+X, "^X"
DEFINE BAR _MED_COPY OF _medit PROMPT "\<Copy" ;
        KEY CTRL+C, "^C"
DEFINE BAR _MED_PASTE OF _medit PROMPT "\<Paste" ;
        KEY CTRL+V, "^V"
DEFINE BAR _MED_CLEAR OF _medit PROMPT "Clear"
DEFINE BAR _MED_SP200 OF _medit PROMPT "\-"
DEFINE BAR _MED_SLCTA OF _medit PROMPT "Select \<All" ;
        KEY CTRL+A, "^A"
DEFINE BAR _MED_SP300 OF _medit PROMPT "\-"
DEFINE BAR _MED_GOTO OF _medit PROMPT "Goto \<Line..."
DEFINE BAR _MED_FIND OF _medit PROMPT "\<Find..." ;
        KEY CTRL+F, "^F"
DEFINE BAR _MED_FINDA OF _medit PROMPT "Find A\<gain" ;
        KEY CTRL+G, "^G"
DEFINE BAR _MED_REPL OF _medit PROMPT "R\<eplace And Find Again" ;
        KEY CTRL+E, "^E"
DEFINE BAR _MED_REPLA OF _medit PROMPT "Replace All"
DEFINE BAR _MED_SP400 OF _medit PROMPT "\-"
DEFINE BAR _MED_PREF OF _medit PROMPT "Prefere\<nces..."

DEFINE POPUP _mdata MARGIN RELATIVE SHADOW COLOR SCHEME 4
DEFINE BAR _MDA_SETUP OF _mdata PROMPT "Set\<up..."
DEFINE BAR _MDA_BROW OF _mdata PROMPT "\<Browse"
DEFINE BAR _MDA_SP100 OF _mdata PROMPT "\-"
DEFINE BAR _MDA_APPND OF _mdata PROMPT "\<Append From..."
DEFINE BAR _MDA_COPY OF _mdata PROMPT "\<Copy To..."
DEFINE BAR _MDA_SORT OF _mdata PROMPT "\<Sort..."
DEFINE BAR _MDA_TOTAL OF _mdata PROMPT "\<Total..."
DEFINE BAR _MDA_SP200 OF _mdata PROMPT "\-"
DEFINE BAR _MDA_AVG OF _mdata PROMPT "A\<verage..."
DEFINE BAR _MDA_COUNT OF _mdata PROMPT "C\<ount..."
DEFINE BAR _MDA_SUM OF _mdata PROMPT "Su\<m..."
DEFINE BAR _MDA_CALC OF _mdata PROMPT "Calculat\<e..."
DEFINE BAR _MDA_REPRT OF _mdata PROMPT "\<Report..."
DEFINE BAR _MDA_LABEL OF _mdata PROMPT "\<Label..."
DEFINE BAR _MDA_SP300 OF _mdata PROMPT "\-"
DEFINE BAR _MDA_PACK OF _mdata PROMPT "\<Pack"
DEFINE BAR _MDA_RINDX OF _mdata PROMPT "Reinde\<x"

DEFINE POPUP _mrecord MARGIN RELATIVE SHADOW COLOR SCHEME 4
DEFINE BAR _MRC_APPND OF _mrecord PROMPT "\<Append"
DEFINE BAR _MRC_CHNGE OF _mrecord PROMPT "Chang\<e"
DEFINE BAR _MRC_SP100 OF _mrecord PROMPT "\-"
DEFINE BAR _MRC_GOTO OF _mrecord PROMPT "\<Goto..."
DEFINE BAR _MRC_LOCAT OF _mrecord PROMPT "\<Locate..."
DEFINE BAR _MRC_CONT OF _mrecord PROMPT "\<Continue" ;
        KEY CTRL+K, "^K"
DEFINE BAR _MRC_SEEK OF _mrecord PROMPT "\<Seek..."
DEFINE BAR _MRC_SP200 OF _mrecord PROMPT "\-"
DEFINE BAR _MRC_REPL OF _mrecord PROMPT "Re\<place..."
DEFINE BAR _MRC_DELET OF _mrecord PROMPT "\<Delete..."
DEFINE BAR _MRC_RECAL OF _mrecord PROMPT "\<Recall..."
```

```
DEFINE POPUP _mprog MARGIN RELATIVE SHADOW COLOR SCHEME 4
DEFINE BAR _MPR_DO OF _mprog PROMPT "\<Do..." ;
        KEY CTRL+D, "^D"
DEFINE BAR _MPR_SP100 OF _mprog PROMPT "\-"
DEFINE BAR _MPR_CANCL OF _mprog PROMPT "\<Cancel"
DEFINE BAR _MPR_RESUM OF _mprog PROMPT "\<Resume" ;
        KEY CTRL+M, "^M"
DEFINE BAR _MPR_SP200 OF _mprog PROMPT "\-"
DEFINE BAR _MPR_COMPL OF _mprog PROMPT "Co\<mpile..."
DEFINE BAR _MPR_GENER OF _mprog PROMPT "Ge\<nerate..."
DEFINE BAR _MPR_DOCUM OF _mprog PROMPT "Fo\<xDoc"
DEFINE BAR _MPR_GRAPH OF _mprog PROMPT "Fox\<Graph..."

DEFINE POPUP _mwindow MARGIN RELATIVE SHADOW COLOR SCHEME 4
DEFINE BAR _MWI_HIDE OF _mwindow PROMPT "\<Hide"
DEFINE BAR _MWI_HIDEA OF _mwindow PROMPT "\<Hide All"
DEFINE BAR _MWI_SHOWA OF _mwindow PROMPT "Sh\<ow All"
DEFINE BAR _MWI_CLEAR OF _mwindow PROMPT "Clea\<r"
DEFINE BAR _MWI_SP100 OF _mwindow PROMPT "\-"
DEFINE BAR _MWI_MOVE OF _mwindow PROMPT "\<Move" ;
        KEY CTRL+F7, "^F7"
DEFINE BAR _MWI_SIZE OF _mwindow PROMPT "\<Size" ;
        KEY CTRL+F8, "^F8"
DEFINE BAR _MWI_ZOOM OF _mwindow PROMPT "\<Zoom " ;
        KEY CTRL+F10, "^F10"
DEFINE BAR _MWI_MIN OF _mwindow PROMPT "Z\<oom " ;
        KEY CTRL+F9, "^F9"
DEFINE BAR _MWI_ROTAT OF _mwindow PROMPT "\<Cycle" ;
        KEY CTRL+F1, "^F1"
DEFINE BAR _MWI_COLOR OF _mwindow PROMPT "Co\<lor..."
DEFINE BAR _MWI_SP200 OF _mwindow PROMPT "\-"
DEFINE BAR _MWI_CMD OF _mwindow PROMPT "Command" ;
        KEY CTRL+F2, "^F2"
DEFINE BAR _MWI_DEBUG OF _mwindow PROMPT "\<Debug"
DEFINE BAR _MWI_TRACE OF _mwindow PROMPT "\<Trace"
DEFINE BAR _MWI_VIEW OF _mwindow PROMPT "\<View"
```

```
*       VDDDDDDDDDDDDDDDDDDDDDDDDDDDDDDDDDDDDDDDDDDDDDDDDDDDDDDDDDDDDDDDD7
*       :                                                                 :
*       : 05/18/93            DELPARTD.SPR                   18:59:37     :
*       :                                                                 :
*       SDDDDDDDDDDDDDDDDDDDDDDDDDDDDDDDDDDDDDDDDDDDDDDDDDDDDDDDDDDDDDDDD=

#REGION 0
REGIONAL m.currarea, m.talkstat, m.compstat

IF SET("TALK") = "ON"
        SET TALK OFF
        m.talkstat = "ON"
ELSE
        m.talkstat = "OFF"
ENDIF
m.compstat = SET("COMPATIBLE")
SET COMPATIBLE FOXPLUS

*       VDDDDDDDDDDDDDDDDDDDDDDDDDDDDDDDDDDDDDDDDDDDDDDDDDDDDDDDDDDDDDDDD7
*       :                                                                 :
*       :                    Window definitions                           :
*       :                                                                 :
*       SDDDDDDDDDDDDDDDDDDDDDDDDDDDDDDDDDDDDDDDDDDDDDDDDDDDDDDDDDDDDDDDD=
*

IF NOT WEXIST("_qfx14pkpk")
        DEFINE WINDOW _qfx14pkpk ;
                FROM INT((SROW()-12)/2),INT((SCOL()-55)/2) ;
                TO INT((SROW()-12)/2)+11,INT((SCOL()-55)/2)+54 ;
                NOFLOAT ;
                NOCLOSE ;
                SHADOW ;
                DOUBLE ;
                COLOR SCHEME 1
ENDIF


*       VDDDDDDDDDDDDDDDDDDDDDDDDDDDDDDDDDDDDDDDDDDDDDDDDDDDDDDDDDDDDDDDD7
*       :                                                                 :
*       :                  DELPARTD Screen Layout                         :
*       :                                                                 :
*       SDDDDDDDDDDDDDDDDDDDDDDDDDDDDDDDDDDDDDDDDDDDDDDDDDDDDDDDDDDDDDDDD=
*

#REGION 1
IF WVISIBLE("_qfx14pkpk")
        ACTIVATE WINDOW _qfx14pkpk SAME
ELSE
        ACTIVATE WINDOW _qfx14pkpk NOSHOW
ENDIF
@ 6,9 SAY "Are you sure you want to do this??"
@ 0,1 SAY "You have asked to delete the following ingredient:"
@ 4,4 SAY "It will be deleted from all of the recipes."
@ 2,9 SAY curpart ;
        SIZE 1,34
@ 1,7 TO 3,44 DOUBLE
@ 8,15 GET YesNo ;
        PICTURE "@*HT \!\<OK;\<Cancel" ;
        SIZE 1,8,5 ;
        DEFAULT 1 ;
        VALID _qfx14p11x()

IF NOT WVISIBLE("_qfx14pkpk")
        ACTIVATE WINDOW _qfx14pkpk
ENDIF

READ CYCLE

RELEASE WINDOW _qfx14pkpk

#REGION 0
IF m.talkstat = "ON"
        SET TALK ON
ENDIF
IF m.compstat = "ON"
        SET COMPATIBLE ON
```

```
ENDIF

*       VDDDDDDDDDDDDDDDDDDDDDDDDDDDDDDDDDDDDDDDDDDDDDDDDDDDDDDDDDDDDDDDDDDD7
*       :                                                                   :
*       : _QFX14PL1X            YesNo VALID                                 :
*       :                                                                   :
*       : Function Origin:                                                  :
*       :                                                                   :
*       : From Screen:          DELPARTD,     Record Number:    8           :
*       : Variable:             YesNo                                       :
*       : Called By:            VALID Clause                                :
*       : Object Type:          Push Button                                 :
*       : Snippet Number:       1                                           :
*       :                                                                   :
*       SDDDDDDDDDDDDDDDDDDDDDDDDDDDDDDDDDDDDDDDDDDDDDDDDDDDDDDDDDDDDDDDDDDD=
*
* User pressed OK (YesNo=1) or Cancel (YesNo=2) in response to delete
* part dialogue.  Delete the part if appropriate and return to parts screen.

FUNCTION _qfx14pl1x     &&  YesNo VALID
#REGION 1
if YesNo = 1                  && user OK'ed the delete
  select part
  delete for alltrim(pname)==alltrim(curpart)

  select wp
  set order to tag pname
  delete for alltrim(pname)==alltrim(curpart)
  set order to tag wname
endif
```

```
*       VDDDDDDDDDDDDDDDDDDDDDDDDDDDDDDDDDDDDDDDDDDDDDDDDDDDDDDDDDDDD7
*       :                                                            :
*       : 06/04/93              STATS.SPR                 14:37:40 :
*       :                                                            :
*       SDDDDDDDDDDDDDDDDDDDDDDDDDDDDDDDDDDDDDDDDDDDDDDDDDDDDDDDDDDDD=

#REGION 0
REGIONAL m.currarea, m.talkstat, m.compstat

IF SET("TALK") = "ON"
        SET TALK OFF
        m.talkstat = "ON"
ELSE
        m.talkstat = "OFF"
ENDIF
m.compstat = SET("COMPATIBLE")
SET COMPATIBLE FOXPLUS

*       VDDDDDDDDDDDDDDDDDDDDDDDDDDDDDDDDDDDDDDDDDDDDDDDDDDDDDDDDDDDD7
*       :                                                            :
*       :                    Window definitions                      :
*       :                                                            :
*       SDDDDDDDDDDDDDDDDDDDDDDDDDDDDDDDDDDDDDDDDDDDDDDDDDDDDDDDDDDDD=
*

IF NOT WEXIST("_qge0vcp0k")
        DEFINE WINDOW _qge0vcp0k ;
                FROM INT((SROW()-10)/2),INT((SCOL()-77)/2) ;
                TO INT((SROW()-10)/2)+9,INT((SCOL()-77)/2)+76 ;
                NOFLOAT ;
                NOCLOSE ;
                SHADOW ;
                COLOR SCHEME 1
ENDIF

*       VDDDDDDDDDDDDDDDDDDDDDDDDDDDDDDDDDDDDDDDDDDDDDDDDDDDDDDDDDDDD7
*       :                                                            :
*       :              STATS Setup Code - SECTION 2                  :
*       :                                                            :
*       SDDDDDDDDDDDDDDDDDDDDDDDDDDDDDDDDDDDDDDDDDDDDDDDDDDDDDDDDDDDD=
*

#REGION 1
set topic to "Statistics"  && Help info for Part screen

push menu _msysmenu
set sysmenu to

select order
count to total
total = alltrim(str(total))

*       VDDDDDDDDDDDDDDDDDDDDDDDDDDDDDDDDDDDDDDDDDDDDDDDDDDDDDDDDDDDD7
*       :                                                            :
*       :                    STATS Screen Layout                     :
*       :                                                            :
*       SDDDDDDDDDDDDDDDDDDDDDDDDDDDDDDDDDDDDDDDDDDDDDDDDDDDDDDDDDDDD=
*

#REGION 1
IF WVISIBLE("_qge0vcp0k")
        ACTIVATE WINDOW _qge0vcp0k SAME
ELSE
        ACTIVATE WINDOW _qge0vcp0k NOSHOW
ENDIF
@ 1,17 SAY date() ;
        SIZE 1,10
@ 3,49 SAY total ;
        SIZE 1,10 ;
        PICTURE "@T"
@ 1,3 SAY "Today's date:"
@ 6,24 GET exit ;
```

```
        PICTURE "@*HT \!\<Exit Statistics Screen" ;
        SIZE 1,26,1 ;
        DEFAULT 1
@ 3,3 SAY " Total no. of CFD menus ordered as of today: "

IF NOT WVISIBLE("_qge0vcp0k")
        ACTIVATE WINDOW _qge0vcp0k
ENDIF

READ CYCLE

RELEASE WINDOW _qge0vcp0k

#REGION 0
IF m.talkstat = "ON"
        SET TALK ON
ENDIF
IF m.compstat = "ON"
        SET COMPATIBLE ON
ENDIF


*       VDDDDDDDDDDDDDDDDDDDDDDDDDDDDDDDDDDDDDDDDDDDDDDDDDDDDDDDDDDDDD7
*       :                                                              :
*       :                    STATS Cleanup Code                        :
*       :                                                              :
*       SDDDDDDDDDDDDDDDDDDDDDDDDDDDDDDDDDDDDDDDDDDDDDDDDDDDDDDDDDDDDD=
*

#REGION 1
pop menu _msysmenu
activate menu _msysmenu
```

```
*       VDDDDDDDDDDDDDDDDDDDDDDDDDDDDDDDDDDDDDDDDDDDDDDDDDDDDDDDDDDDDDDDDDDD7
*       :                                                                    :
*       : 06/19/93              WIDGET.SPR                   23:35:37        :
*       :                                                                    :
*       SDDDDDDDDDDDDDDDDDDDDDDDDDDDDDDDDDDDDDDDDDDDDDDDDDDDDDDDDDDDDDDDDDDD=

#REGION 0
REGIONAL m.currarea, m.talkstat, m.compstat

IF SET("TALK") = "ON"
        SET TALK OFF
        m.talkstat = "ON"
ELSE
        m.talkstat = "OFF"
ENDIF
m.compstat = SET("COMPATIBLE")
SET COMPATIBLE FOXPLUS

*       VDDDDDDDDDDDDDDDDDDDDDDDDDDDDDDDDDDDDDDDDDDDDDDDDDDDDDDDDDDDDDDDDDDD7
*       :                                                                    :
*       :                      Window definitions                            :
*       :                                                                    :
*       SDDDDDDDDDDDDDDDDDDDDDDDDDDDDDDDDDDDDDDDDDDDDDDDDDDDDDDDDDDDDDDDDDDD=
*

IF NOT WEXIST("_qgt1ekial")
        DEFINE WINDOW _qgt1ekial ;
                FROM INT((SROW()-22)/2),INT((SCOL()-73)/2) ;
                TO INT((SROW()-22)/2)+21,INT((SCOL()-73)/2)+72 ;
                TITLE "[ Welcome to the Recipes Screen --- For help, please press F1 ]" ;
                NOFLOAT ;
                NOCLOSE ;
                SHADOW ;
                COLOR SCHEME 13
ENDIF

#REGION 1
DEFINE POPUP _qgt1ekimm ;
        PROMPT FIELD Widget.wname ;
        SCROLL ;
        MARGIN ;
        MARK ""

*       VDDDDDDDDDDDDDDDDDDDDDDDDDDDDDDDDDDDDDDDDDDDDDDDDDDDDDDDDDDDDDDDDDDD7
*       :                                                                    :
*       :                    WIDGET Screen Layout                            :
*       :                                                                    :
*       SDDDDDDDDDDDDDDDDDDDDDDDDDDDDDDDDDDDDDDDDDDDDDDDDDDDDDDDDDDDDDDDDDDD=
*

#REGION 1
IF WVISIBLE("_qgt1ekial")
        ACTIVATE WINDOW _qgt1ekial SAME
ELSE
        ACTIVATE WINDOW _qgt1ekial NOSHOW
ENDIF
@ 9,37 GET newwidget ;
        SIZE 1,30 ;
        DEFAULT " " ;
        VALID _qgt1ekir9()
@ 4,2 GET curwidget ;
        PICTURE "@&N" ;
        POPUP _qgt1ekimm ;
        SIZE 13,32 ;
        DEFAULT " " ;
        WHEN _qgt1ekj3n() ;
        VALID _qgt1ekj9g() ;
        COLOR SCHEME 13
@ 1,12 SAY "In this screen, you can review existing recipes or"
@ 2,19 SAY "enter new recipes into the database."
@ 6,36 SAY "To create a new recipe, enter its"
```

```
@ 18,9 GET deletebutton ;
        PICTURE "@*HN \<Delete Recipe" ;
        SIZE 1,17,1 ;
        DEFAULT 1 ;
        VALID _qgt1ekjhk()
@ 15,41 GET button ;
        PICTURE "@*HT \<Exit Recipe Screen" ;
        SIZE 1,22,4 ;
        DEFAULT 1

IF NOT WVISIBLE("_qgt1ekial")
        ACTIVATE WINDOW _qgt1ekial
ENDIF

READ CYCLE

RELEASE WINDOW _qgt1ekial
RELEASE POPUPS _qgt1ekimm

#REGION 0
IF m.talkstat = "ON"
        SET TALK ON
ENDIF
IF m.compstat = "ON"
        SET COMPATIBLE ON
ENDIF


*       VDDDDDDDDDDDDDDDDDDDDDDDDDDDDDDDDDDDDDDDDDDDDDDDDDDDDDDDDDDDDD7
*       :                                                              :
*       : _QGT1EKIR9            newwidget VALID                        :
*       :                                                              :
*       : Function Origin:                                             :
*       :                                                              :
*       : From Screen:          WIDGET,     Record Number:    7        :
*       : Variable:             newwidget                              :
*       : Called By:            VALID Clause                           :
*       : Object Type:          Field                                  :
*       : Snippet Number:       1                                      :
*       :                                                              :
*       SDDDDDDDDDDDDDDDDDDDDDDDDDDDDDDDDDDDDDDDDDDDDDDDDDDDDDDDDDDDDD=
*
* This code is executed when the user enters a new widget name then presses
* ENTER

* It is only executed if the user did indeed enter a widget name and did not
* just press enter on a blank prompt

FUNCTION _qgt1ekir9     &&  newwidget VALID
#REGION 1
private PushButton, New

newwidget = ltrim(newwidget)    && remove leading blanks
if !empty(newwidget)
  * See if widget already exists
  select widget
  set order to tag wname
  locate for upper(wname) = upper(newwidget)
  if found()
    newwidget = ""  && clear out the users input for new input
    show get newwidget
    keyboard "{DEL}{DEL}{DEL}{DEL}{DEL}{DEL}{DEL}{DEL}{DEL}{DEL}{DEL}{DEL}{DEL}{DEL}{DEL}{DEL}{DEL}{DEL}{DEL}{DEL}"
    _curobj = 1
    ?? chr(7)         && beep
    return .f.        && keeps user in prompt field
  endif

  * If it doesnt exist, add it
  append blank
  replace wname with newwidget
  clear gets
  clear read all
  curwidget = newwidget  && wedit will edit widget curwidget
  New = .t.
```

```
  PushButton = 1
  do wtype.spr                    && prologue to wedit - force user to choose wtype
  if PushButton == 1
    do wedit.spr
  endif
endif

*       VDDDDDDDDDDDDDDDDDDDDDDDDDDDDDDDDDDDDDDDDDDDDDDDDDDDDDDDDDDDDDDDD7
*       :                                                                 :
*       : _QGT1EKJ3N            curwidget WHEN                            :
*       :                                                                 :
*       : Function Origin:                                                :
*       :                                                                 :
*       : From Screen:          WIDGET,     Record Number:    8           :
*       : Variable:             curwidget                                 :
*       : Called By:            WHEN Clause                               :
*       : Object Type:          List                                      :
*       : Snippet Number:       2                                         :
*       :                                                                 :
*       SDDDDDDDDDDDDDDDDDDDDDDDDDDDDDDDDDDDDDDDDDDDDDDDDDDDDDDDDDDDDDDDD=
*
FUNCTION _qgt1ekj3n     &&  curwidget WHEN
#REGION 1
select widget
set deleted off
count for deleted() to x
set deleted on
if reccount() - x == 0
  _curobj = _curobj + 1
else
  if empty(curwidget)
    keyboard "{HOME}"
  endif
endif
*show get curwidget

*       VDDDDDDDDDDDDDDDDDDDDDDDDDDDDDDDDDDDDDDDDDDDDDDDDDDDDDDDDDDDDDDDD7
*       :                                                                 :
*       : _QGT1EKJ9G            curwidget VALID                           :
*       :                                                                 :
*       : Function Origin:                                                :
*       :                                                                 :
*       : From Screen:          WIDGET,     Record Number:    8           :
*       : Variable:             curwidget                                 :
*       : Called By:            VALID Clause                              :
*       : Object Type:          List                                      :
*       : Snippet Number:       3                                         :
*       :                                                                 :
*       SDDDDDDDDDDDDDDDDDDDDDDDDDDDDDDDDDDDDDDDDDDDDDDDDDDDDDDDDDDDDDDDD=
*
* This code is executed after the user selects a widget from the widgets
* list. Name of this widget goes in curwidget which is where wedit expects
* to find name of widget selected for editing.

* It is only executed if the user did indeed select something either
* by pressing ENTER or double mouse click
FUNCTION _qgt1ekj9g     &&  curwidget VALID
#REGION 1
if !empty(curwidget)
  do wedit.spr
  clear gets
  clear read all
endif
```

```
*       VDDDDDDDDDDDDDDDDDDDDDDDDDDDDDDDDDDDDDDDDDDDDDDDDDDDDDDDDDDDDDDDDDDD7
*       :                                                                    :
*       : _QGT1EKJHK            deletebutton VALID                           :
*       :                                                                    :
*       : Function Origin:                                                   :
*       :                                                                    :
*       : From Screen:          WIDGET,     Record Number:   13              :
*       : Variable:             deletebutton                                 :
*       : Called By:            VALID Clause                                 :
*       : Object Type:          Push Button                                  :
*       : Snippet Number:       4                                            :
*       :                                                                    :
*       SDDDDDDDDDDDDDDDDDDDDDDDDDDDDDDDDDDDDDDDDDDDDDDDDDDDDDDDDDDDDDDDDDDD=
*
* User has asked to delete selected widget (curwidget) from the database.
* The curwidget tuple in Widget will be deleted and all WP tuples with
* wname = curwidget will be deleted.

FUNCTION _qgt1ekjhk     &&  deletebutton VALID
#REGION 1
if !empty(curwidget)
  select widget
  delete for alltrim(wname)==alltrim(curwidget)
  curwidget = wname
  show get curwidget enable       && redisplay widgets list

  select wp
  set order to tag wname
  delete for alltrim(wname)==alltrim(curwidget)

  _curobj = 2           && move cursor to widgets list
endif
```

```
*       *
*       :                                                       :
*       : 06/20/93              WTYPE.SPR               00:13:04 :
*       :                                                       :
*       SDDDDDDDDDDDDDDDDDDDDDDDDDDDDDDDDDDDDDDDDDDDDDDDDDDDDDDDDDDD=

#REGION 0
REGIONAL m.currarea, m.talkstat, m.compstat

IF SET("TALK") = "ON"
        SET TALK OFF
        m.talkstat = "ON"
ELSE
        m.talkstat = "OFF"
ENDIF
m.compstat = SET("COMPATIBLE")
SET COMPATIBLE FOXPLUS

*       VDDDDDDDDDDDDDDDDDDDDDDDDDDDDDDDDDDDDDDDDDDDDDDDDDDDDDDDDDDD7
*       :                                                       :
*       :                     Window definitions                :
*       :                                                       :
*       SDDDDDDDDDDDDDDDDDDDDDDDDDDDDDDDDDDDDDDDDDDDDDDDDDDDDDDDDDDD=
*

IF NOT WEXIST("_qgu00gtdi")
        DEFINE WINDOW _qgu00gtdi ;
                FROM INT((SROW()-19)/2),INT((SCOL()-65)/2) ;
                TO INT((SROW()-19)/2)+18,INT((SCOL()-65)/2)+64 ;
                NOFLOAT ;
                NOCLOSE ;
                SHADOW ;
                COLOR SCHEME 13
ENDIF

*       VDDDDDDDDDDDDDDDDDDDDDDDDDDDDDDDDDDDDDDDDDDDDDDDDDDDDDDDDDDD7
*       :                                                       :
*       :               WTYPE Setup Code - SECTION 2            :
*       :                                                       :
*       SDDDDDDDDDDDDDDDDDDDDDDDDDDDDDDDDDDDDDDDDDDDDDDDDDDDDDDDDDDD=
*

#REGION 1
* If the user is entering a new widget, then the cancel button is disabled

if New
  show get PushButton,2 disable
else
  widgetype = widget.wtype
  show get widgetype
endif

*       VDDDDDDDDDDDDDDDDDDDDDDDDDDDDDDDDDDDDDDDDDDDDDDDDDDDDDDDDDDD7
*       :                                                       :
*       :                    WTYPE Screen Layout                :
*       :                                                       :
*       SDDDDDDDDDDDDDDDDDDDDDDDDDDDDDDDDDDDDDDDDDDDDDDDDDDDDDDDDDDD=
*

#REGION 1
IF WVISIBLE("_qgu00gtdi")
        ACTIVATE WINDOW _qgu00gtdi SAME
ELSE
        ACTIVATE WINDOW _qgu00gtdi NOSHOW
ENDIF
@ 1,2 SAY " Please choose a category for the recipe you are editing."
@ 5,4 GET widgetype ;
        PICTURE "@*RVN \<Appetizer;S\<oup;S\<alad;\<Entree;S\<ide Dish;\<Dessert"
        SIZE 1,13,1 ;
        DEFAULT 1
```

```
@ 8,48 GET PushButton ;
        PICTURE "@*VT \!\<Done;\?\<Cancel" ;
        SIZE 1,10,1 ;
        DEFAULT 1 ;
        VALID _qgu00gtxo()
@ 2,6 SAY "Select DONE when you are finished or CANCEL to exit"
@ 3,16 SAY "without changing the category."

IF NOT WVISIBLE("_qgu00gtdi")
        ACTIVATE WINDOW _qgu00gtdi
ENDIF

READ CYCLE

RELEASE WINDOW _qgu00gtdi

#REGION 0
IF m.talkstat = "ON"
        SET TALK ON
ENDIF
IF m.compstat = "ON"
        SET COMPATIBLE ON
ENDIF


*       VDDDDDDDDDDDDDDDDDDDDDDDDDDDDDDDDDDDDDDDDDDDDDDDDDDDDDDDDDDDDD7
*       :                                                              :
*       : _QGU00GTXO            PushButton VALID                       :
*       :                                                              :
*       : Function Origin:                                             :
*       :                                                              :
*       : From Screen:          WTYPE,     Record Number:    9         :
*       : Variable:             PushButton                             :
*       : Called By:            VALID Clause                           :
*       : Object Type:          Push Button                            :
*       : Snippet Number:       1                                      :
*       :                                                              :
*       SDDDDDDDDDDDDDDDDDDDDDDDDDDDDDDDDDDDDDDDDDDDDDDDDDDDDDDDDDDDDD=
*
FUNCTION _qgu00gtxo     && PushButton VALID
#REGION 1
if pushbutton = 1
  select widget
  replace widget.wtype with widgetype
endif
```

```
*
*
*       06/19/93            LIST2.SPR               21:46:47
*
*


*REGION 0
PUBLIC m.currarea, m.talkstat, m.compstat

IF SET("TALK") = "ON"
        SET TALK OFF
        m.talkstat = "ON"
ELSE
        m.talkstat = "OFF"
ENDIF
m.compstat = SET("COMPATIBLE")
SET COMPATIBLE FOXPLUS

*
*
*                       Window definitions
*
*
*


IF NOT WEXIST("_qqtlaojn0")
        DEFINE WINDOW  qqtlaojn0 ;
                FROM INT((SROW()-21)/2),INT((SCOL()-75)/2) ;
                TO INT((SROW()-21)/2)+20,INT((SCOL()-75)/2)+78 ;
                TITLE "| Create a CFD menu --- For help, please press F1 |" ;
                NOFLOAT ;
                NOCLOSE ;
                SHADOW ;
                COLOR SCHEME 13
ENDIF


*
*
*               LIST2 Setup Code - SECTION 2
*
*
*


*REGION 1
set sysmenu off
on key label f1 do cfdhelp with "Menu"

select restrict
use

clear gets                      && clear get field for custname
clear read all
keyboard "{DEL}{DEL}{DEL}{DEL}{DEL}{DEL}{DEL}{DEL}{DEL}{DEL}{DEL}{DEL}{DEL}{DEL}{DEL}{DEL}{DEL}{DEL}{DEL}{DEL}{DEL}{DEL}{DEL}{DEL}{DEL}{D
EL}{DEL}{DEL}{DEL}{DEL}{DEL}{DEL}{DEL}{DEL}{DEL}{DEL}{DEL}{DEL}{DEL}{DEL}{DEL}{DEL}{DEL}{DEL}{DEL}{DEL}{DEL}{DEL}{DEL}{DEL}{DEL}"


*REGION 1
DEFINE POPUP _qqtlaoklj ;
        PROMPT FIELD Part.pname ;
        SCROLL ;
        MARGIN ;
        MARK ""
```

```
*       VDDDDDDDDDDDDDDDDDDDDDDDDDDDDDDDDDDDDDDDDDDDDDDDDDDDDDDDDDDDDDD7
*       :                                                               :
*       :                    LIST2 Screen Layout                        :
*       :                                                               :
*       SDDDDDDDDDDDDDDDDDDDDDDDDDDDDDDDDDDDDDDDDDDDDDDDDDDDDDDDDDDDDDD=
*

#REGION 1
IF WVISIBLE("_qgt1aojn0")
        ACTIVATE WINDOW _qgt1aojn0 SAME
ELSE
        ACTIVATE WINDOW _qgt1aojn0 NOSHOW
ENDIF
@ 3,54 SAY "s"
@ 3,11 SAY "All Ingredients"
@ 1,1 SAY "Please enter customer name: "
@ 1,29 GET custname ;
        SIZE 1,43 ;
        DEFAULT " " ;
        PICTURE "@T" ;
        VALID _qgt1aok81()
@ 4,3 GET partslist ;
        PICTURE "@&N" ;
        POPUP _qgt1aok1j ;
        SIZE 13,32 ;
        DEFAULT " " ;
        WHEN _qgt1aoke3() ;
        VALID _qgt1aokjz() ;
        COLOR SCHEME 13
@ 4,37 GET rparts ;
        PICTURE "@&N" ;
        POPUP _qgt1aok1t ;
        SIZE 13,32 ;
        DEFAULT " " ;
        WHEN _qgt1aokrf() ;
        VALID _qgt1aokxc() ;
        COLOR SCHEME 13
@ 3,41 SAY "Restricted Ingredients"
@ 18,20 GET print ;
        PICTURE "@*HT \!\<Print Menu" ;
        SIZE 1,14,1 ;
        DEFAULT 1 ;
        VALID _qgt1aol3i()
@ 18,41 GET exit ;
        PICTURE "@*HT \<Exit" ;
        SIZE 1,8,1 ;
        DEFAULT 1

IF NOT WVISIBLE("_qgt1aojn0")
        ACTIVATE WINDOW _qgt1aojn0
ENDIF

READ CYCLE

RELEASE WINDOW _qgt1aojn0
RELEASE POPUPS _qgt1aok1j, _qgt1aok1t

#REGION 0
IF m.talkstat = "ON"
        SET TALK ON
ENDIF
IF m.compstat = "ON"
        SET COMPATIBLE ON
ENDIF
```

```
*       VDDDDDDDDDDDDDDDDDDDDDDDDDDDDDDDDDDDDDDDDDDDDDDDDDDDDDDDDDDDDD7
*       :                                                              :
*       :                    LIST2 Cleanup Code                        :
*       :                                                              :
*       SDDDDDDDDDDDDDDDDDDDDDDDDDDDDDDDDDDDDDDDDDDDDDDDDDDDDDDDDDDDDD=
*

#REGION 1
set sysmenu on
on key label f1 do cfdhelp with "", "MENU"
set topic to
custname = ""
* show get custname
* clear gets                    && clear get field for custname
* clear read all
activate menu _msysmenu

*       VDDDDDDDDDDDDDDDDDDDDDDDDDDDDDDDDDDDDDDDDDDDDDDDDDDDDDDDDDDDDD7
*       :                                                              :
*       : _QGT1AOK81            custname VALID                         :
*       :                                                              :
*       : Function Origin:                                             :
*       :                                                              :
*       : From Screen:          LIST2,     Record Number:   10         :
*       : Variable:             custname                               :
*       : Called By:            VALID Clause                           :
*       : Object Type:          Field                                  :
*       : Snippet Number:       1                                      :
*       :                                                              :
*       SDDDDDDDDDDDDDDDDDDDDDDDDDDDDDDDDDDDDDDDDDDDDDDDDDDDDDDDDDDDDD=
*
* This code is executed when the user enters a customer name.

FUNCTION _qgt1aok81     &&  custname VALID
#REGION 1
custname = alltrim(custname)    && remove leading and trailing blanks


*       VDDDDDDDDDDDDDDDDDDDDDDDDDDDDDDDDDDDDDDDDDDDDDDDDDDDDDDDDDDDDD7
*       :                                                              :
*       : _QGT1AOKE3            partslist WHEN                         :
*       :                                                              :
*       : Function Origin:                                             :
*       :                                                              :
*       : From Screen:          LIST2,     Record Number:   11         :
*       : Variable:             partslist                              :
*       : Called By:            WHEN Clause                            :
*       : Object Type:          List                                   :
*       : Snippet Number:       2                                      :
*       :                                                              :
*       SDDDDDDDDDDDDDDDDDDDDDDDDDDDDDDDDDDDDDDDDDDDDDDDDDDDDDDDDDDDDD=
*
FUNCTION _qgt1aoke3     &&  partslist WHEN
#REGION 1
select part
set deleted off
count for deleted() to x
set deleted on
if reccount() - x == 0
  _curobj = _curobj + 1
else
  if empty(partslist)
    keyboard "{HOME}"
    *show get partslist
  endif
endif
```

```
*       VDDDDDDDDDDDDDDDDDDDDDDDDDDDDDDDDDDDDDDDDDDDDDDDDDDDDDDDDDDDDDDDD7
*       :                                                                 :
*       : _QGT1AOKJZ            partslist VALID                           :
*       :                                                                 :
*       : Function Origin:                                                :
*       :                                                                 :
*       : From Screen:          LIST2,     Record Number:   11            :
*       : Variable:             partslist                                 :
*       : Called By:            VALID Clause                              :
*       : Object Type:          List                                      :
*       : Snippet Number:       3                                         :
*       :                                                                 :
*       SDDDDDDDDDDDDDDDDDDDDDDDDDDDDDDDDDDDDDDDDDDDDDDDDDDDDDDDDDDDDDDDD=
*
* This code is executed after the user selects a part from the parts list

FUNCTION _qgt1aokjz     &&  partslist VALID
#REGION 1
select restrict
* Order by part name
set order to tag pname
* See if part already exists
locate for upper(pname) = upper(partslist)
if !found()
  append blank
  replace restrict.pname with partslist
  show get rparts
endif

if lastkey() = 13
  _curobj = 2           && obj1 = custname field, obj2 = partslist
endif


*       VDDDDDDDDDDDDDDDDDDDDDDDDDDDDDDDDDDDDDDDDDDDDDDDDDDDDDDDDDDDDDDDD7
*       :                                                                 :
*       : _QGT1AOKRF            rparts WHEN                               :
*       :                                                                 :
*       : Function Origin:                                                :
*       :                                                                 :
*       : From Screen:          LIST2,     Record Number:   12            :
*       : Variable:             rparts                                    :
*       : Called By:            WHEN Clause                               :
*       : Object Type:          List                                      :
*       : Snippet Number:       4                                         :
*       :                                                                 :
*       SDDDDDDDDDDDDDDDDDDDDDDDDDDDDDDDDDDDDDDDDDDDDDDDDDDDDDDDDDDDDDDDD=
*
FUNCTION _qgt1aokrf     &&  rparts WHEN
#REGION 1
select restrict
set deleted off
count for deleted() to x
set deleted on
if reccount() - x == 0
  _curobj = _curobj + 1
```

```
else
  if empty(rparts)
    keyboard "{HOME}"
    *show get rparts
  endif
endif

*       VDDDDDDDDDDDDDDDDDDDDDDDDDDDDDDDDDDDDDDDDDDDDDDDDDDDDDDDDDDDDDDDDDDD7
*       :                                                                    :
*       : _QGT1AOKXC            rparts VALID                                 :
*       :                                                                    :
*       : Function Origin:                                                   :
*       :                                                                    :
*       : From Screen:          LIST2,      Record Number:   12              :
*       : Variable:             rparts                                       :
*       : Called By:            VALID Clause                                 :
*       : Object Type:          List                                         :
*       : Snippet Number:       5                                            :
*       :                                                                    :
*       SDDDDDDDDDDDDDDDDDDDDDDDDDDDDDDDDDDDDDDDDDDDDDDDDDDDDDDDDDDDDDDDDDDD=
*
FUNCTION _qgt1aokxc     &&  rparts VALID
#REGION 1
if lastkey() = 13
  delete for restrict.pname = rparts
  rparts = restrict.pname
  show get rparts
  _curobj = 3  && stay in rparts
  keyboard "{dnarrow}"
endif

*       VDDDDDDDDDDDDDDDDDDDDDDDDDDDDDDDDDDDDDDDDDDDDDDDDDDDDDDDDDDDDDDDDDDD7
*       :                                                                    :
*       : _QGT1AOL3I            print VALID                                  :
*       :                                                                    :
*       : Function Origin:                                                   :
*       :                                                                    :
*       : From Screen:          LIST2,      Record Number:   14              :
*       : Variable:             print                                        :
*       : Called By:            VALID Clause                                 :
*       : Object Type:          Push Button                                  :
*       : Snippet Number:       6                                            :
*       :                                                                    :
*       SDDDDDDDDDDDDDDDDDDDDDDDDDDDDDDDDDDDDDDDDDDDDDDDDDDDDDDDDDDDDDDDDDDD=
*
FUNCTION _qgt1aol3i     &&  print VALID
#REGION 1
select order                                    && add new tuple to order relation
append blank
replace cname with custname
replace date with date()

set filter to
do report
@ 0,0 clear
do list2.spr
```

```
*       VDDDDDDDDDDDDDDDDDDDDDDDDDDDDDDDDDDDDDDDDDDDDDDDDDDDDDDDDDDDDDDDDDDD7
*       :                                                                   :
*       : 06/19/93              PART.SPR                    21:47:57        :
*       :                                                                   :
*       SDDDDDDDDDDDDDDDDDDDDDDDDDDDDDDDDDDDDDDDDDDDDDDDDDDDDDDDDDDDDDDDDDDD=

#REGION 0
REGIONAL m.currarea, m.talkstat, m.compstat

IF SET("TALK") = "ON"
        SET TALK OFF
        m.talkstat = "ON"
ELSE
        m.talkstat = "OFF"
ENDIF
m.compstat = SET("COMPATIBLE")
SET COMPATIBLE FOXPLUS

*       VDDDDDDDDDDDDDDDDDDDDDDDDDDDDDDDDDDDDDDDDDDDDDDDDDDDDDDDDDDDDDDDDDDD7
*       :                                                                   :
*       :                       Window definitions                          :
*       :                                                                   :
*       SDDDDDDDDDDDDDDDDDDDDDDDDDDDDDDDDDDDDDDDDDDDDDDDDDDDDDDDDDDDDDDDDDDD=
*

IF NOT WEXIST("_qgt1aq1vq")
        DEFINE WINDOW _qgt1aq1vq ;
                FROM INT((SROW()-22)/2),INT((SCOL()-74)/2) ;
                TO INT((SROW()-22)/2)+21,INT((SCOL()-74)/2)+73 ;
                TITLE "[ Welcome to the Ingredients Screen --- For help, please press F1 ]"
                NOFLOAT ;
                NOCLOSE ;
                SHADOW ;
                COLOR SCHEME 13
ENDIF

*       VDDDDDDDDDDDDDDDDDDDDDDDDDDDDDDDDDDDDDDDDDDDDDDDDDDDDDDDDDDDDDDDDDDD7
*       :                                                                   :
*       :                 PART Setup Code - SECTION 2                       :
*       :                                                                   :
*       SDDDDDDDDDDDDDDDDDDDDDDDDDDDDDDDDDDDDDDDDDDDDDDDDDDDDDDDDDDDDDDDDDDD=
*

#REGION 1
set sysmenu off
on key label f1 do cfdhelp with "Ingredients"
select part
set order to tag pname
go top

#REGION 1
DEFINE POPUP _qgt1aq262 ;
        PROMPT FIELD part.pname ;
        SCROLL ;
        MARGIN ;
        MARK ""

*       VDDDDDDDDDDDDDDDDDDDDDDDDDDDDDDDDDDDDDDDDDDDDDDDDDDDDDDDDDDDDDDDDDDD7
*       :                                                                   :
*       :                     PART Screen Layout                            :
*       :                                                                   :
*       SDDDDDDDDDDDDDDDDDDDDDDDDDDDDDDDDDDDDDDDDDDDDDDDDDDDDDDDDDDDDDDDDDDD=
*

#REGION 1
IF WVISIBLE("_qgt1aq1vq")
        ACTIVATE WINDOW _qgt1aq1vq SAME
ELSE
```

```
ENDIF
@ 11,39 GET newpart ;
        SIZE 1,30 ;
        DEFAULT " " ;
        VALID _qgt1aq281()
@ 4,2 GET curpart ;
        PICTURE "@&N" ;
        POPUP _qgt1aq262 ;
        SIZE 13,32 ;
        DEFAULT " " ;
        WHEN _qgt1aq2hx() ;
        COLOR SCHEME 13
@ 8,38 SAY "Type in new ingredient name here "
@ 9,38 SAY "and hit enter."
@ 2,16 SAY " delete existing ingredients from the database."
@ 18,8 GET deletebutton ;
        PICTURE "@*HN \<Delete Ingredient" ;
        SIZE 1,21,1 ;
        DEFAULT 1 ;
        VALID _qgt1aq2pp()
@ 1,3 SAY "In this screen, you can add new ingredients to the database or"
@ 15,41 GET pushbutton ;
        PICTURE "@*HT \<Exit Ingredients Screen" ;
        SIZE 1,27,4 ;
        DEFAULT 1

IF NOT WVISIBLE("_qgt1aq1vq")
        ACTIVATE WINDOW _qgt1aq1vq
ENDIF

READ CYCLE

RELEASE WINDOW _qgt1aq1vq
RELEASE POPUPS _qgt1aq262

#REGION 0
IF m.talkstat = "ON"
        SET TALK ON
ENDIF
IF m.compstat = "ON"
        SET COMPATIBLE ON
ENDIF


*       VDDDDDDDDDDDDDDDDDDDDDDDDDDDDDDDDDDDDDDDDDDDDDDDDDDDDDDDDDDDD7
*       :                                                            :
*       :                    PART Cleanup Code                       :
*       :                                                            :
*       SDDDDDDDDDDDDDDDDDDDDDDDDDDDDDDDDDDDDDDDDDDDDDDDDDDDDDDDDDDDD=
*

#REGION 1
on key label f1 do cfdhelp with "", "MENU"
set topic to
set sysmenu on
activate menu _msysmenu
```

```
*
*
*       _QGTlaQZ4L          newpart v.
*
*       Function Origin:
*
*       From Screen:        PART,     Record Number:    2
*       Variable:           newpart
*       Called By:          VALID Clause
*       Object Type:        Field
*       Snippet Number:     1
*
*
*
* This is called when the user presses enter on
* the new part field.

* We will only add a new part to the table if the
* user actually entered something.
FUNCTION _qgtlaq2R1     && newpart VALID
DREGION 1
newpart = ltrim(newpart)        && remove leading and trailing blanks
if !empty(newpart)
  * Make sure the part doesnt already exist
  select part  && selects the part table
  * The pname field and the newpart field MUST be the same length.
  locate for upper(pname) = upper(newpart)
  if found()
    * if it does exist, don't add it, stay on same prompt for the user
    ?? chr(7)  && beep
    keyboard "{DEL}{DEL}{DEL}{DEL}{DEL}{DEL}{DEL}{DEL}{DEL}{DEL}{DEL}{DEL}{DEL}{DEL}{DEL}{DEL}{DEL}{DEL}{DEL}{DEL}{DEL}{DEL}{DEL}{DEL}{DEL}{DEL}{DE
L}"
    return .f.
  else
    * If it doesnt exist, add it
    append blank  && appends a blank record to it
    replace part.pname with newpart  && updates the pname field
    show gets  && redisplay the list with the new record
    newpart = ""  && clear out the variable for a new entry
    _curobj = 1  && stay on the same prompt
  endif
endif

*
*
*       _QGTlaQZ8X          curpart WHEN
*
*       Function Origin:
*
*       From Screen:        PART,     Record Number:    3
*       Variable:           curpart
*       Called By:          WHEN Clause
*       Object Type:        List
*       Snippet Number:     2
*
*
*
FUNCTION  qgtlaq2hx     && curpart WHEN
DREGION 1
select part
set deleted off
count for deleted() to x
set deleted on
if reccount() - x == 0
  _curobj =  curobj + 1
else
  if empty(curpart)
    keyboard "{home}"
  endif
  *show get curpart
endif
```

```
*       VDDDDDDDDDDDDDDDDDDDDDDDDDDDDDDDDDDDDDDDDDDDDDDDDDDDDDDDDDDDDDDDDD7
*       :                                                                  :
*       : _QGT1AQ2PP            deletebutton VALID                         :
*       :                                                                  :
*       : Function Origin:                                                 :
*       :                                                                  :
*       : From Screen:          PART,     Record Number:    7              :
*       : Variable:             deletebutton                               :
*       : Called By:            VALID Clause                               :
*       : Object Type:          Push Button                                :
*       : Snippet Number:       3                                          :
*       :                                                                  :
*       SDDDDDDDDDDDDDDDDDDDDDDDDDDDDDDDDDDDDDDDDDDDDDDDDDDDDDDDDDDDDDDDDD=
*
* User has asked to delete selected part (curpart) from the database.
* The curpart tuple in Part will be deleted and all WP tuples with
* pname = curpart will be deleted.

* Prompt user to make sure he/she wants to delete part,
* and do the delete if the user said OK.
FUNCTION _qgt1aq2pp     &&  deletebutton VALID
#REGION 1
if !empty(curpart)
  do DelPartD.spr
  curpart = part.pname
endif

show get curpart enable         && redisplay parts list with curpart deleted
_curobj = 2                                     && move cursor to parts list
```

```
                                        *       VDDDDDDDDDDDDDDDDDDDDDDDDDDDDDDDDDDDI
*       :                                                                       :
*       : 06/20/93              WELCOME.SPR                     07:28:39        :
*       :                                                                       :
*       SDDDDDDDDDDDDDDDDDDDDDDDDDDDDDDDDDDDDDDDDDDDDDDDDDDDDDDDDDDDDDDDDDDDDDD=

#REGION 0
REGIONAL m.currarea, m.talkstat, m.compstat

IF SET("TALK") = "ON"
        SET TALK OFF
        m.talkstat = "ON"
ELSE
        m.talkstat = "OFF"
ENDIF
m.compstat = SET("COMPATIBLE")
SET COMPATIBLE FOXPLUS

*       VDDDDDDDDDDDDDDDDDDDDDDDDDDDDDDDDDDDDDDDDDDDDDDDDDDDDDDDDDDDDDDDDDDDDDD7
*       :                                                                       :
*       :                       Window definitions                              :
*       :                                                                       :
*       SDDDDDDDDDDDDDDDDDDDDDDDDDDDDDDDDDDDDDDDDDDDDDDDDDDDDDDDDDDDDDDDDDDDDDD=
*

IF NOT WEXIST("_qgu0g0z7r")
        DEFINE WINDOW _qgu0g0z7r ;
                FROM INT((SROW()-16)/2),INT((SCOL()-71)/2) ;
                TO INT((SROW()-16)/2)+15,INT((SCOL()-71)/2)+70 ;
                FOOTER "[ Press Any Key To Continue... ]" ;
                NOFLOAT ;
                NOCLOSE ;
                SHADOW ;
                COLOR SCHEME 13
ENDIF

*       VDDDDDDDDDDDDDDDDDDDDDDDDDDDDDDDDDDDDDDDDDDDDDDDDDDDDDDDDDDDDDDDDDDDDDD7
*       :                                                                       :
*       :               WELCOME Setup Code - SECTION 2                          :
*       :                                                                       :
*       SDDDDDDDDDDDDDDDDDDDDDDDDDDDDDDDDDDDDDDDDDDDDDDDDDDDDDDDDDDDDDDDDDDDDDD=
*

#REGION 1
set cursor off

*       VDDDDDDDDDDDDDDDDDDDDDDDDDDDDDDDDDDDDDDDDDDDDDDDDDDDDDDDDDDDDDDDDDDDDDD7
*       :                                                                       :
*       :                       WELCOME Screen Layout                           :
*       :                                                                       :
*       SDDDDDDDDDDDDDDDDDDDDDDDDDDDDDDDDDDDDDDDDDDDDDDDDDDDDDDDDDDDDDDDDDDDDDD=
*

#REGION 1
IF WVISIBLE("_qgu0g0z7r")
        ACTIVATE WINDOW _qgu0g0z7r SAME
ELSE
        ACTIVATE WINDOW _qgu0g0z7r NOSHOW
ENDIF
@ 1,30 SAY " Welcome"
@ 2,33 SAY "to"
@ 3,31 SAY "CFDware"
@ 6,20 SAY "Software for CAREFREE DINING"
@ 10,19 SAY "Copyright, 1993, ALLERTEX, INC."
@ 5,48 SAY "TM"
@ 9,49 SAY "TM"
```

```
IF NOT WVISIBLE("_qgu0g0z7r")
        ACTIVATE WINDOW _qgu0g0z7r
ENDIF

READ CYCLE

RELEASE WINDOW _qgu0g0z7r

#REGION 0
IF m.talkstat = "ON"
        SET TALK ON
ENDIF
IF m.compstat = "ON"
        SET COMPATIBLE ON
ENDIF


*       VDDDDDDDDDDDDDDDDDDDDDDDDDDDDDDDDDDDDDDDDDDDDDDDDDDDDDDDDDDDD7
*       :                                                            :
*       :                    WELCOME Cleanup Code                    :
*       :                                                            :
*       SDDDDDDDDDDDDDDDDDDDDDDDDDDDDDDDDDDDDDDDDDDDDDDDDDDDDDDDDDDDD=
*

#REGION 1
set cursor on
```

```
*       VDDDDDDDDDDDDDDDDDDDDDDDDDDDDDDDDDDDDDDDDDDDDDDDDDDDDDDDDDDDDDDDDDDD7
*       :                                                                    :
*       : 06/20/93              WEDIT.SPR                        02:41:50 :
*       :                                                                    :
*       SDDDDDDDDDDDDDDDDDDDDDDDDDDDDDDDDDDDDDDDDDDDDDDDDDDDDDDDDDDDDDDDDDDD=

#REGION 0
REGIONAL m.currarea, m.talkstat, m.compstat

IF SET("TALK") = "ON"
        SET TALK OFF
        m.talkstat = "ON"
ELSE
        m.talkstat = "OFF"
ENDIF
m.compstat = SET("COMPATIBLE")
SET COMPATIBLE FOXPLUS

*       VDDDDDDDDDDDDDDDDDDDDDDDDDDDDDDDDDDDDDDDDDDDDDDDDDDDDDDDDDDDDDDDDDDD7
*       :                                                                    :
*       :                      Window definitions                            :
*       :                                                                    :
*       SDDDDDDDDDDDDDDDDDDDDDDDDDDDDDDDDDDDDDDDDDDDDDDDDDDDDDDDDDDDDDDDDDDD=
*

IF NOT WEXIST("_qgu05s416")
        DEFINE WINDOW _qgu05s416 ;
                FROM INT((SROW()-23)/2),INT((SCOL()-70)/2) ;
                TO INT((SROW()-23)/2)+22,INT((SCOL()-70)/2)+69 ;
                TITLE "[ Select Ingredients for Current Recipe ]" ;
                NOFLOAT ;
                NOCLOSE ;
                SHADOW ;
                COLOR SCHEME 13
ENDIF

*       VDDDDDDDDDDDDDDDDDDDDDDDDDDDDDDDDDDDDDDDDDDDDDDDDDDDDDDDDDDDDDDDDDDD7
*       :                                                                    :
*       :                WEDIT Setup Code - SECTION 2                        :
*       :                                                                    :
*       SDDDDDDDDDDDDDDDDDDDDDDDDDDDDDDDDDDDDDDDDDDDDDDDDDDDDDDDDDDDDDDDDDDD=
*

#REGION 1
* Initialization code for the wedit screen.
* curwidget is name of widget being edited.

select widget
set order to tag wname

select part
set order to tag pname
select wp
set order to tag pname

* limit view of WP to tuples of curwidget
set filter to upper(wp.wname) = upper(curwidget)

#REGION 1
DEFINE POPUP _qgu05s4wy ;
        PROMPT FIELD Part.pname ;
        SCROLL ;
        MARGIN ;
        MARK ""

DEFINE POPUP _qgu05s4x6 ;
        PROMPT FIELD WP.pname ;
        SCROLL ;
        MARGIN ;
        MARK ""
```

```
*
*
*        EDIT Screen Layout
*
*
*

DEFINE REGION 1
IF VISIBLE('_qqu05s416')
        ACTIVATE WINDOW _qqu05s416 SAME
ELSE
        ACTIVATE WINDOW _qqu05s416 NOSHOW
ENDIF
@ 6,1 GET partslist ;
        PICTURE "@&N" ;
        POPUP _qqu05s4vy ;
        SIZE 13,32 ;
        DEFAULT " " ;
        WHEN _qqu05s508() ;
        VALID _qqu05s55z() ;
        COLOR SCHEME 13
@ 6,35 GET corrparts ;
        PICTURE "@&N" ;
        POPUP _qqu05s4z6 ;
        SIZE 13,32 ;
        DEFAULT " " ;
        WHEN _qqu05s5ej() ;
        VALID _qqu05s5kf() ;
        COLOR SCHEME 13
@ 2,6 SAY corwidget ;
        SIZE 1,30
@ 5,30 SAY "All Ingredients"
@ 5,41 SAY "Recipe Ingredients"
@ 1,1 TO 3,40 DOUBLE
@ 2,46 SAY iif(widget.wtype=1, "Appetizer", iif(widget.wtype=2, "Soup", iif(widget.wtype=3, "Salad", iif(widget.wtype=4, "Entree", iif(w
dget.wtype=5, "Side Dish", "Dessert")))) ;
        SIZE 1,15
@ 1,44 TO 1,62
@ 20,5 GET change ;
        PICTURE "@*HN \<Change Recipe Category" ;
        SIZE 1,24,1 ;
        DEFAULT 1 ;
        VALID _qqu05s5t2()
@ 20,40 GET pushbutton ;
        PICTURE "@*HN \!\<Done Editing Recipe" ;
        SIZE 1,21,1 ;
        DEFAULT 1

IF NOT VISIBLE('_qqu05s416')
        ACTIVATE WINDOW _qqu05s416
ENDIF

READ CYCLE ;
        SHOW _qqu05s5zlll

RELEASE WINDOW _qqu05s416
RELEASE POPUPS _qqu05s4vy, _qqu05s4z6

DEFINE REGION 4
IF m.talkstat = "ON"
        SET TALK ON
ENDIF
IF m.compstat = "ON"
        SET COMPATIBLE ON
ENDIF
```

```
-FUNCTION _qgu05s55z     &&  partslist VALID
#REGION 1
select wp
* Order WP by part name to enable seeking on WP.pname
set order to tag pname
* If part doesn't already exist in curent widget, then add it
locate for upper(pname) = upper(partslist)
if !found()
  append blank
  replace wp.wname with curwidget
  replace wp.pname with partslist
  show get currparts
endif
* Order by widget name
* set order to tag wname

if lastkey() = 13
  _curobj = 1
endif


*       VDDDDDDDDDDDDDDDDDDDDDDDDDDDDDDDDDDDDDDDDDDDDDDDDDDDDDDDDDDDD7
*       :                                                             :
*       : _QGU05S5EJ            currparts WHEN                        :
*       :                                                             :
*       : Function Origin:                                            :
*       :                                                             :
*       : From Screen:          WEDIT,     Record Number:    4        :
*       : Variable:             currparts                             :
*       : Called By:            WHEN Clause                           :
*       : Object Type:          List                                  :
*       : Snippet Number:       3                                     :
*       :                                                             :
*       SDDDDDDDDDDDDDDDDDDDDDDDDDDDDDDDDDDDDDDDDDDDDDDDDDDDDDDDDDDDD=
*
FUNCTION _qgu05s5ej     &&  currparts WHEN
#REGION 1
select wp
set deleted off
count for deleted() or !(upper(wp.wname) = upper(curwidget)) to x
*count for !(upper(wp.wname) = upper(curwidget)) to y
set deleted on
if reccount() - x == 0
  _curobj = _curobj + 1
else
  if empty(currparts)
    keyboard "{HOME}"
  endif
endif

*       VDDDDDDDDDDDDDDDDDDDDDDDDDDDDDDDDDDDDDDDDDDDDDDDDDDDDDDDDDDDD7
*       :                                                             :
*       : _QGU05S5KF            currparts VALID                       :
*       :                                                             :
*       : Function Origin:                                            :
*       :                                                             :
*       : From Screen:          WEDIT,     Record Number:    4        :
*       : Variable:             currparts                             :
*       : Called By:            VALID Clause                          :
*       : Object Type:          List                                  :
*       : Snippet Number:       4                                     :
*       :                                                             :
*       SDDDDDDDDDDDDDDDDDDDDDDDDDDDDDDDDDDDDDDDDDDDDDDDDDDDDDDDDDDDD=
*
```

```
FUNCTION _qgu05s5kf     &&  currparts VALID
#REGION 1
if lastkey() = 13
  delete for wp.pname=currparts and wp.wname=curwidget
  currparts = wp.pname
  show get currparts
  _curobj = 2
  keyboard "{dnarrow}"
endif

*       VDDDDDDDDDDDDDDDDDDDDDDDDDDDDDDDDDDDDDDDDDDDDDDDDDDDDDDDDDDDDDDDD7
*       :                                                                 :
*       : _QGU05S5T2            change VALID                              :
*       :                                                                 :
*       : Function Origin:                                                :
*       :                                                                 :
*       : From Screen:          WEDIT,      Record Number:   11           :
*       : Variable:             change                                    :
*       : Called By:            VALID Clause                              :
*       : Object Type:          Push Button                               :
*       : Snippet Number:       5                                         :
*       :                                                                 :
*       SDDDDDDDDDDDDDDDDDDDDDDDDDDDDDDDDDDDDDDDDDDDDDDDDDDDDDDDDDDDDDDDD=
*
* User wants to change the recipe category
FUNCTION _qgu05s5t2     &&  change VALID
#REGION 1
private New
New = .f.
do wtype.spr
* if wtype say object moves, next statement must also be changed
@ 2,46 say space(15)
@ 2,46 say iif(widget.wtype=1, "Appetizer", iif(widget.wtype=2, "Soup", iif(widget.
if(widget.wtype=5, "Side Dish", "Dessert")))))


*       VDDDDDDDDDDDDDDDDDDDDDDDDDDDDDDDDDDDDDDDDDDDDDDDDDDDDDDDDDDDDDDDD7
*       :                                                                 :
*       : _QGU05S5ZL            Read Level Show                           :
*       :                                                                 :
*       : Function Origin:                                                :
*       :                                                                 :
*       : From Screen:          WEDIT                                     :
*       : Called By:            READ Statement                            :
*       : Snippet Number:       6                                         :
*       :                                                                 :
*       SDDDDDDDDDDDDDDDDDDDDDDDDDDDDDDDDDDDDDDDDDDDDDDDDDDDDDDDDDDDDDDDD=
*
FUNCTION _qgu05s5zl     && Read Level Show
PRIVATE currwind
STORE WOUTPUT() TO currwind
*
* Show Code from screen: WEDIT
*
#REGION 1
IF SYS(2016) = "_QGU05S4L6" OR SYS(2016) = "*"
        ACTIVATE WINDOW _qgu05s416 SAME
        @ 2,46 SAY iif(widget.wtype=1, "Appetizer", iif(widget.wtype=2, "Soup", iii
tree", iif(widget.wtype=5, "Side Dish", "Dessert"))))) ;
                SIZE 1,15
ENDIF
IF NOT EMPTY(currwind)
        ACTIVATE WINDOW (currwind) SAME
ENDIF
```

I claim:

1. A method of making an individualized restaurant menu for a customer desirous of avoiding ingestion of selected ingredients, said method comprising the following steps:

loading a database into a computer;

loading a plurality of names of ingredients into said database, said ingredients comprising all ingredients used by the restaurant;

loading a plurality of recipes into said data base, each recipe comprising ingredients selected from the ingredients, the names of which are in the database;

inquiring of the customer which of the ingredients the customer wishes to avoid;

accessing the database by an input device at the restaurant;

entering into the database, via said input device, a name of an ingredient which the customer has selected as to-be-avoided;

analyzing the database by instructing the computer to:

search the database of recipes for the ingredient to-be-avoided and select from said database all available recipes not containing the ingredient selected as to-be-avoided;

outputting to an output device, a menu, perceptible to the customer and customized for said customer, said menu comprising a list of names of servings, said servings consisting of the selected available recipes;

thereby safeguarding the customer against ingestion of the ingredient selected as to-be-avoided.

2. A method according to claim 1 further comprising the steps of:

determining a name of the customer;

entering the customer's name into the database in association with the names of the ingredients to-be-avoided when the names of the ingredients to-be-avoided are entered; and printing the customer's name and a list of ingredients to-be-avoided on the menu.

3. A method to claim 1 in which the output device is a printer and the menu is a printed menu.

4. A method of making an individualized restaurant menu for a customer desirous of avoiding ingestion of selected ingredients, said method comprising the following steps:

loading a database into a computer;

loading a plurality of names of ingredients into said database, said ingredients comprising all ingredients used by the restaurant;

loading a plurality of recipes into said data base, each recipe comprising recipe ingredients selected from the ingredients, the names of which are in the database;

inquiring of the customer which of the ingredients the customer wishes to avoid;

accessing the database from the restaurant;

entering into the database a name of an ingredient which the customer has selected as to-be-avoided by the following steps:

displaying upon a display screen at least a portion of the plurality of names of ingredients;

said display screen comprising a cursor;

manipulating said display screen, by an interactive human control apparatus, to focus the cursor upon the name of the ingredient selected as to-be-avoided;

manipulating said interactive human control apparatus to enter said cursor-focused name of the ingredient to-be-avoided for comparison to recipe ingredients in the database of recipes;

analyzing the database by instructing the computer to:

search the database of recipes for the ingredient to-be-avoided;

compare the ingredient-to-be-avoided to the recipe ingredients of each recipe, select each recipe whose recipe ingredients do not include the ingredient-to-be-avoided, and output all selected recipes to an output device;

said output device outputting the selected recipe names in a form perceptible to the customer as a menu;

presenting the menu to the customer; thereby safeguarding the customer against ingestion of the ingredient selected as to-be-avoided.

5. A method according to claim 4, in which:

the human interactive control apparatus is a pointing device comprising a pointing means and an actuator;

said display screen comprises control areas;

said step of manipulating said interactive human control apparatus, further comprising:

locating the cursor upon the control area, and triggering the actuator to scroll the portion of the plurality of names of ingredients through the plurality of names of ingredients in order to display, the name of the ingredient selected as to-be-avoided;

manipulating said pointing means to place the cursor upon the name of the ingredient selected as to-be-avoided;

triggering the actuator to enter said cursor-focused name of the ingredient to-be-avoided for comparison to the recipe ingredients in the database of recipes.

6. A method according to claim 4 in which said interactive human control apparatus comprises an alpha-numeric keyboard.

7. A method according to claim 6 in which the cursor is focused upon the name of the ingredient selected as to-be-avoided by depressing keys on the keyboard to begin spelling said name of the ingredient to-be-avoided until a combination of letters is selected, which combination is unique among the plurality of names of ingredients, thereby causing the cursor to focus upon said selected name of the ingredient to-be-avoided;

subsequently entering said name of the ingredient to-be-avoided by depressing a key means for entering said cursor-focused name of the ingredient to-be-avoided, for comparison to recipe ingredients in the database of recipes.

8. A method according to claim 6 in which the portion on the display screen is scrolled through the plurality of names of ingredients by depressing page-up, and page-down key means, and the cursor is moved by depressing arrow-key means for focusing the cursor on the name of the ingredient to-be-avoided, and the name of the ingredient to-be-avoided is entered by depressing an enter-key means.

9. A method according to claim 4 comprising the following further steps:

providing said customized menu to said customer;

taking an order from said customer for one of the names of servings on the list comprising the menu;

preparing said serving, consisting of ingredients named in the recipe corresponding to said serving, and not comprising the ingredient selected as to-be-avoided;

delivering the serving to the customer.

10. A method of making an individualized restaurant menu for a customer desirous of avoiding ingestion of selected ingredients, said method comprising the following steps:

loading a database into a computer;

loading a plurality of names of ingredients into said database, said ingredients comprising all ingredients used by the restaurant;

loading a plurality of recipes into said data base, each recipe comprising recipe ingredients selected from the ingredients, the names of which are in the database;

inquiring of the customer which of the ingredients the customer wishes to avoid;

accessing the database from the restaurant;

entering into the database a name of an ingredient, which the customer has selected as to-be-avoided by the following steps:

displaying upon a display screen at least a portion of the plurality of names of ingredients;

said display screen comprising a cursor;

manipulating said display screen, by an interactive human control apparatus, to focus the cursor upon the name of the ingredient selected as to-be-avoided;

manipulating said interactive human control apparatus to enter said cursor-focused name of the ingredient to-be avoided for comparison to recipe ingredients in the database of recipes;

analyzing the database by instructing the computer to:

search the database of recipes for the ingredient to-be-avoided, compare the ingredient-to-be-avoided to the recipe ingredients of each recipe, select each recipe whose recipe ingredients do not include the ingredient-to-be-avoided, and output names of the selected recipes to an output device, said output device presenting the selected recipe names to the customer in a form perceptible to the customer as a menu;

presenting the menu to the customer;

receiving a choice of a recipe name from the customer;

preparing a serving according to a recipe corresponding to the chosen recipe name, said meal not containing the ingredient-to-be-avoided;

delivering said serving to said customer and thereby locating said serving at said customer;

thereby safeguarding the customer against ingestion of the ingredient selected as to-be-avoided.

11. A method according to claim 10 in which:

the output device is a printer;

outputting includes printing:

the names of the selected recipes, a name of the customer, and the name of the ingredient-to-be-avoided on a menu;

presenting includes delivering the menu to the customer;

the customer chooses a recipe name by marking the chosen recipe name on the menu;

receiving the choice includes receiving the marked menu from the customer;

further comprising delivering the marked menu to a kitchen;

preparing the meal includes observing the name of the ingredient-to-be-avoided and specifically excluding the ingredient-to-be-avoided; and serving the meal includes:

observing the customer's name, confirming said name to the customer, and delivering said meal to the customer with the marked menu.

* * * * *